US011864651B2

(12) United States Patent
Lobbezoo

(10) Patent No.: US 11,864,651 B2
(45) Date of Patent: Jan. 9, 2024

(54) CLOSING DEVICE FOR DRAWERS

(71) Applicant: KNAPE & VOGT MANUFACTURING COMPANY, Grand Rapids, MI (US)

(72) Inventor: Edward Allen Lobbezoo, Hudsonville, MI (US)

(73) Assignee: KNAPE & VOGT MANUFACTURING COMPANY, Grand Rapids, MI (US)

( * ) Notice: Subject to any disclaimer, the term of this patent is extended or adjusted under 35 U.S.C. 154(b) by 26 days.

(21) Appl. No.: 17/614,917

(22) PCT Filed: Jun. 5, 2019

(86) PCT No.: PCT/US2019/035588
§ 371 (c)(1),
(2) Date: Nov. 29, 2021

(87) PCT Pub. No.: WO2020/246974
PCT Pub. Date: Dec. 10, 2020

(65) Prior Publication Data

US 2022/0232973 A1 Jul. 28, 2022

(51) Int. Cl.
*A47B 88/467* (2017.01)

(52) U.S. Cl.
CPC ..... *A47B 88/467* (2017.01)

(58) Field of Classification Search
CPC ..... A47B 88/467; A47B 88/40; E05F 1/16; E05F 5/003
See application file for complete search history.

(56) References Cited

U.S. PATENT DOCUMENTS

| | | | |
|---|---|---|---|
| 4,642,449 | A | 2/1987 | Baitz et al. |
| 5,015,048 | A | 5/1991 | Brunnert |
| 5,240,318 | A | 8/1993 | Schroder et al. |
| 6,629,738 | B2 | 10/2003 | Salice |
| 6,848,759 | B2 | 2/2005 | Doornbos et al. |
| 6,910,557 | B2 | 6/2005 | Doombos et al. |

(Continued)

FOREIGN PATENT DOCUMENTS

| | | | |
|---|---|---|---|
| CA | 2819278 | A1 | 6/2012 |
| WO | WO 2008069248 | A1 | 6/2008 |

OTHER PUBLICATIONS

International Search Report of the International Searching Authority prepared by the USPTO in connection with PCT/US2019/035588, dated Aug. 23, 2019; (10 pages).

*Primary Examiner* — Hanh V Tran
(74) *Attorney, Agent, or Firm* — Cook Alex Ltd.

(57) ABSTRACT

A closing device includes a rack body having an elongated rack and being slidably coupled to a base, with a catch pivotally coupled to the rack body and a gear pivotally coupled to the base and engaging the elongated rack. A first biasing member is coupled to the base and rack body and provides a substantially linear biasing force. A second biasing member is coupled to the base and gear, and the elongated rack and gear engagement provides a mechanical advantage and a non-linear biasing force. The closing device is for use in a drawer slide having a latch coupled to a first drawer slide member and the base coupled to a second drawer slide member, with the latch releasably coupled to the catch to move the drawer slide to a closed position.

23 Claims, 18 Drawing Sheets

(56) References Cited

U.S. PATENT DOCUMENTS

| | | | | |
|---|---|---|---|---|
| 6,915,716 | B2 | 7/2005 | Doornbos et al. | |
| 6,932,511 | B2 | 8/2005 | Doornbos et al. | |
| 7,077,488 | B2 | 7/2006 | Wiklund et al. | |
| 7,281,773 | B2 | 10/2007 | Sato et al. | |
| 7,815,267 | B1 | 10/2010 | Frousiakis | |
| 8,083,304 | B2 * | 12/2011 | Hu | A47B 88/467 312/319.1 |
| 8,186,010 | B2 * | 5/2012 | Tomiji | E05F 5/027 16/75 |
| 8,210,624 | B2 * | 7/2012 | Jurja | A47B 88/467 312/319.1 |
| 8,511,764 | B1 * | 8/2013 | Chen | A47B 88/467 312/319.1 |
| 10,512,328 | B2 * | 12/2019 | Pan | E05F 5/027 |
| 10,745,955 | B2 * | 8/2020 | Svara | E05F 1/16 |
| 10,966,521 | B2 * | 4/2021 | Chen | A47B 88/49 |
| 11,272,784 | B2 * | 3/2022 | Meusburger | A47B 88/493 |
| 11,585,593 | B2 * | 2/2023 | Eom | A47B 88/467 |
| 2001/0008037 | A1 | 7/2001 | Brustle | |
| 2004/0104649 | A1 | 6/2004 | Muller et al. | |
| 2004/0107535 | A1 | 6/2004 | Hollenstein | |
| 2004/0183411 | A1 | 9/2004 | Boks | |
| 2004/0197035 | A1 | 10/2004 | Doornbos et al. | |
| 2007/0046158 | A1 | 3/2007 | Hoffman | |
| 2008/0197759 | A1 | 8/2008 | Chen et al. | |
| 2008/0224584 | A1 | 9/2008 | Weber et al. | |
| 2008/0244862 | A1 | 10/2008 | Tooyama | |
| 2008/0263819 | A1 | 10/2008 | Tomioka et al. | |
| 2009/0021129 | A1 | 1/2009 | Hu et al. | |
| 2009/0033187 | A1 | 2/2009 | Chung | |
| 2011/0101839 | A1 | 5/2011 | Boks | |
| 2012/0019012 | A1 * | 1/2012 | Saito | E05C 19/02 292/68 |
| 2013/0028544 | A1 * | 1/2013 | Lowe | A47B 88/467 384/19 |
| 2013/0088132 | A1 | 4/2013 | Hammerle | |
| 2014/0079347 | A1 * | 3/2014 | Huang | A47B 88/467 384/21 |
| 2014/0097732 | A1 * | 4/2014 | Xiao | A47B 88/467 312/319.1 |
| 2017/0130501 | A1 * | 5/2017 | Svara | E05F 1/16 |
| 2017/0135478 | A1 * | 5/2017 | Chen | A47B 88/467 |
| 2017/0265644 | A1 | 9/2017 | Fischer et al. | |
| 2018/0087305 | A1 * | 3/2018 | Dubach | E05F 1/1041 |
| 2018/0100338 | A1 * | 4/2018 | Dubach | E05F 1/10 |
| 2018/0132615 | A1 * | 5/2018 | Kim | A47B 88/467 |
| 2018/0203395 | A1 * | 7/2018 | Kang | G03G 15/6508 |

* cited by examiner

CLOSING DEVICE FOR DRAWERS

BACKGROUND

Field of the Invention

The present invention generally relates to closing devices that are incorporated into drawer slides, which are otherwise known as self-closing drawer slides. Such drawer slides tend to be used in articles of furniture, appliances or other structures having movable drawers, such as in the form of cabinet assemblies, for assisting in moving a drawer to a fully closed position.

Discussion of the Prior Art

Articles of furniture having drawers, such as cabinet assemblies, typically include drawer slides for mounting drawers to the cabinet assembly and for providing a way to move the drawer between a fully closed position within the cabinet body to an open position with the drawer extending outward from the cabinet body. Standard drawer slides tend to be mounted in pairs, with one on each of the left and right outer sides of the drawer. Thus, on each side of the drawer, one drawer slide member is attached to the cabinet body and a second drawer slide member is attached to the drawer. Ball or roller bearings, or solid bushings, typically serve as bearings and are disposed between the drawer slide members for smooth movement of the drawer relative to the cabinet body. The bearings may be organized and located within a bearing retainer. Also, there may be a third drawer slide member coupled to and between the first and second drawer slide members, with a corresponding additional set of bearings, to permit further extension of the drawer from the cabinet body.

It is desirable to assist a user in closing a drawer, to prevent rebound of the drawer, and to tend to hold the drawer in a closed position. There are numerous self-closing drawer slide devices designed to be engaged as a drawer is being closed and reaches a predetermined distance from the cabinet face. Such devices often incorporate a spring to help pull or push the drawer to the fully closed position. It is common for these devices to include a latch that is used in controlling the movement of the drawer relative to the cabinet body within a pre-selected range of motion of the drawer. Such prior art devices often include a catch, in the form of a pin, tab or other actuator to engage the latch to move it from a locked to an unlocked position or vice versa. In turn, either the latch or catch commonly is associated with one of the drawer sides or a slide member connected to a drawer side, while the other corresponding component is associated with the cabinet body or another drawer slide member connected to the cabinet body.

While such a latch and catch assembly of a self-closing drawer slide function for their intended purpose, they tend to transmit fairly high forces to the user at the transition point of engagement or disengagement of the latch, as occurs upon release when the drawer is being moved in an outward direction toward an open position and reaches the end of the travel of the latch under the influence of a spring, or upon initial engagement when the drawer is being moved in an inward direction toward a closed position. The prior art devices tend to have a spring with an end that is moved in essentially a one-for-one ratio relative to the movement of a latch, such that the force generated by the spring is increased linearly as the latch is moved outward with the drawer, until the latching member suddenly is released and reaches a locked or armed position. This results in operation with an on-off or lunging feel with respect to the influence of the spring as the latch reaches or is released from the locked position.

Thus, it is common among prior art self-closing drawer slides for the spring force resisting the opening of the drawer to continue to increase in a consistent, linear manner until the latch reaches the end of its travel, and then releases the drawer. This results in an abrupt transition as the latch reaches its locked position, from a maximum pulling force resisting the opening of the drawer to no pulling force resisting further opening of the drawer. This construction tends to provide undesirable, unexpected motion that is unsettling to the user and may cause the contents of the drawer to shift abruptly. Similarly, when closing the drawer, the influence of the spring is brought on rather suddenly when its peak force is applied upon initial reengagement of the latch and release of the catch from its locked position.

This undesirable transition is due, in part, to the need to have the spring maintain a sufficient level of spring force even when the drawer is nearly in a fully closed position, so as to be able to completely close the drawer and to prevent the drawer from rebounding to an open position if pushed inward rapidly, such as when a drawer is being shoved closed. The high spring force at the point of release from the locked position during reengagement of the latch also can result in undesirable noise due to the abrupt movements of the latch into or out of the locked position and the level of force transmitted by the latch to the catch on the other drawer slide, drawer or cabinet member.

The present inventor previously sought to address these issues in U.S. Pat. No. 8,205,951 by providing a closing device for drawers that utilizes mechanical advantage during movement of the latch to mitigate the undesirable transition forces. The closing device also included structure to incorporate a damper to assist in damping rapid movement of a drawer slide member when moving to a closed position, so as to more gently achieve a fully closed position. The device worked very effectively to modulate the forces, but was only suitable for a limited range of drawer load capacity. For instance, it was not suitable for use in heavy duty applications, where the undesirable transition may be even more pronounced due to the need to use closing springs having even greater spring forces. Indeed, to date, the inventor is not aware of anyone solving the abrupt transition problem associated with self-close heavy duty drawer slides, regardless of whether they also incorporate soft-close damping.

SUMMARY

The following discloses example improved closing devices which impart a mechanical advantage that results in the application of a biasing force that is not increased in a consistent or uniform manner when compared to the linear movement of a latching member that is coupled to one of the drawer slide members. Instead of continuing to increase the biasing force to be applied at the disengagement/engagement point of the latching member in a uniform linear rate, the disclosed example closing device has a biasing member but is configured to have a latch that does not move at the same rate as the biasing member is lengthened. Thus, the increase in the biasing force is at a reduced rate per unit length of movement as the drawer slide continues to move outward until the latch reaches its locked or armed position.

The present disclosure provides improved use of a closing device that employs a mechanical advantage during movement of the latch to permit a common biasing member to be used while mitigating undesirable transition forces. The disclosure provides a damper, which optionally may be included to assist in damping rapid movement of a drawer slide member when moving to a closed position, so as to catch a drawer that is coupled to the drawer slide assembly and allow the closing device to assist in more gently moving the drawer to a fully closed position. Hence, the present disclosure addresses shortcomings in prior art self-closing drawer slide assemblies, while providing quiet, smooth-operating closing devices for use with heavy duty drawer slides.

In a first aspect, the present disclosure provides a closing device that includes a base, a rack body slidably coupled to the base and having an elongated rack, a catch pivotally coupled to the rack body, a first biasing member connected at a first end to the base and at an opposed second end to the rack body, and biasing the rack body to move rearward relative to the base. The catch has a locked position at a front of the base, and an unlocked position wherein the catch is movable along the base while being biased toward the rear of the base. A gear is pivotally coupled to the base and engaging the elongated rack of the rack body, and a second biasing member has a first end coupled to the base and an opposed second end coupled to the gear, and biasing the gear to pivot and thereby drive the rack body rearward relative to the base. The first biasing member provides a substantially linear biasing force upon movement of the rack body relative to the base, and the rack and gear engagement provides a mechanical advantage that alters the biasing force applied to the rack body by the second biasing member in a non-linear manner upon movement of the rack body relative to the base.

In a second aspect, the present disclosure presents a closing device, for use in a drawer slide having a first drawer slide member that is slidably coupled to a second drawer slide member, with the closing device including a base connectable to the second drawer slide member, a rack body slidably coupled to the base and having an elongated rack, a catch pivotally coupled to the rack body, a first biasing member connected at a first end to the base and at an opposed second end to the rack body, and biasing the rack body to move rearward relative to the base. The catch has a locked position at a front of the base, and an unlocked position wherein the catch is movable along the base while being biased toward the rear of the base. A gear is pivotally coupled to the base and engaging the rack of the rack body, and a second biasing member has a first end coupled to the base and an opposed second end coupled to the gear, and biasing the gear to pivot and thereby drive the rack body rearward relative to the base. A latch is connectable to the first drawer slide member and configured to be releasably engaged by the catch, wherein the first biasing member provides a substantially linear biasing force upon movement of the rack body relative to the base, and the rack and gear engagement provides a mechanical advantage that alters the biasing force applied to the rack body by the second biasing member in a non-linear manner upon movement of the rack body relative to the base.

It is to be understood that both the foregoing general description and the following detailed description are exemplary and provided for purposes of explanation only, and are not restrictive of the disclosure, as claimed. Further features and objects of the present disclosure will become more fully apparent in the following description of preferred embodiments and from the appended claims.

BRIEF DESCRIPTION OF THE DRAWINGS

In describing the preferred embodiments, reference is made to the accompanying drawings wherein like parts have like reference numerals, and wherein.

It should be understood that the drawings are not to scale and that actual embodiments may differ. It also should be understood that the claims are not limited to the particular examples illustrated or combinations thereof, but rather cover various configurations of closing devices for drawers.

DETAILED DESCRIPTION OF THE PREFERRED EMBODIMENTS

Although the following discloses example closing devices shown for use with drawers coupled to drawer slides, persons of ordinary skill in the art will appreciate that the teachings of this disclosure are in no way limited to the specific examples illustrated, and that the closing devices may be used with sliding systems in various environments, as may typically be found in articles of furniture, such as a cabinet or desk, and in appliances or other structures having movable drawers and the like, which will be collectively referred to herein for convenience as "drawer and cabinet assemblies". Accordingly, it is contemplated that the teachings of this disclosure may be implemented in alternative configurations and environments. In addition, although the example closing devices described herein are shown in conjunction with a particular configuration of a drawer slide assembly, those having ordinary skill in the art will readily recognize that the either the inner or outer slide member may be mounted to the drawer and the opposed slide member may be mounted to the cabinet. Still further, it will be appreciated that the componentry of the example closing devices may be used in a drawer slide, whether of a side mount or undermount construction, or may be mounted independently of a drawer slide to the drawer or cabinet, with the closing mechanism and latch mounted to the opposed components to affect operation of the closing device.

Figure 16:
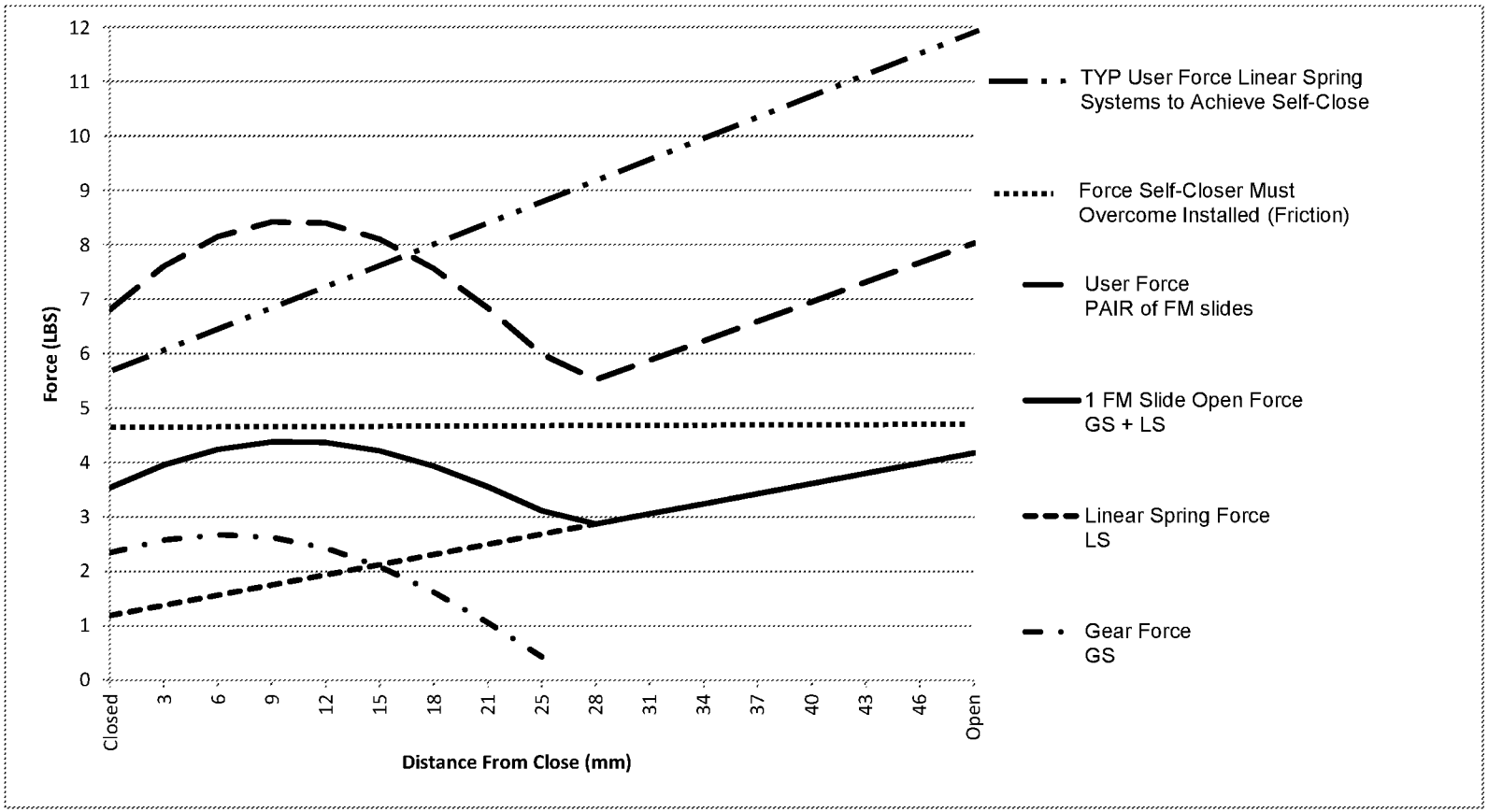
FIG. 16 is a graph showing the relative advantageous influence of the closing device of the present disclosure on the pulling force required to move the drawer slide as the latch is moved from the fully closed position to the locked position, and thereafter as the drawer is moved outward to the fully open position.

Referring to FIGS. 1-15C, it will be appreciated that an example closing device of the present disclosure generally may be embodied within numerous configurations within a device that may be incorporated into a drawer slide assembly, such as in self-closing drawer slides and cabinet assemblies, with advantageous benefits, as demonstrated in part in FIG. 16. Thus, the apparatus and articles of manufacture and methods disclosed herein may be advantageously adapted to enhance or improve the closing features of a drawer slide or drawer within a cabinet assembly, and the present teachings are particularly advantageous with respect to heavy duty sliding systems, such as having a drawer capacity of greater than 100 lbs., but may be implemented with sliding systems having lower capacities, while still providing similar advantages.

Referring to a preferred embodiment in FIGS. 1-15C, an example closing device 10 is shown incorporated into a self-closing drawer slide, of a side mount type. Components of the example closing device 10 are shown in FIGS. 1-4 coupled to a drawer slide 12 having a first drawer slide member 14 for attachment by conventional means to a side of a drawer (not shown), and the first drawer slide member 14 and the drawer are slidably coupled to a second drawer slide member 16, which is provided for attachment by conventional means to an inner surface of side wall of a cabinet (not shown). While the closing device 10 may be used with a drawer slide having two drawer slide members, it will be appreciated that this example includes a third drawer slide member 18 coupled to, slidably engaging and disposed between the first drawer slide member 14 and the second drawer slide member 16. Use of the intermediate, third drawer slide member 18 permits greater extension of a drawer from the face of a cabinet body when fully extended to the open position, and often drawer slides of this type are referred to as full extension drawer slides. However, while the closing device 10 of the preferred embodiment is configured to be coupled to a drawer slide 12 of the full extension side mount type, it will be appreciated that the componentry of the first example drawer closing device 10 of the present disclosure may be incorporated into other configurations, whether incorporated into drawer slides having two or more slide members, into drawer slides of the side mount or undermount type, or into direct mountings to a drawer or cabinet body without being incorporated into one or another drawer slide members.

Figure 2:
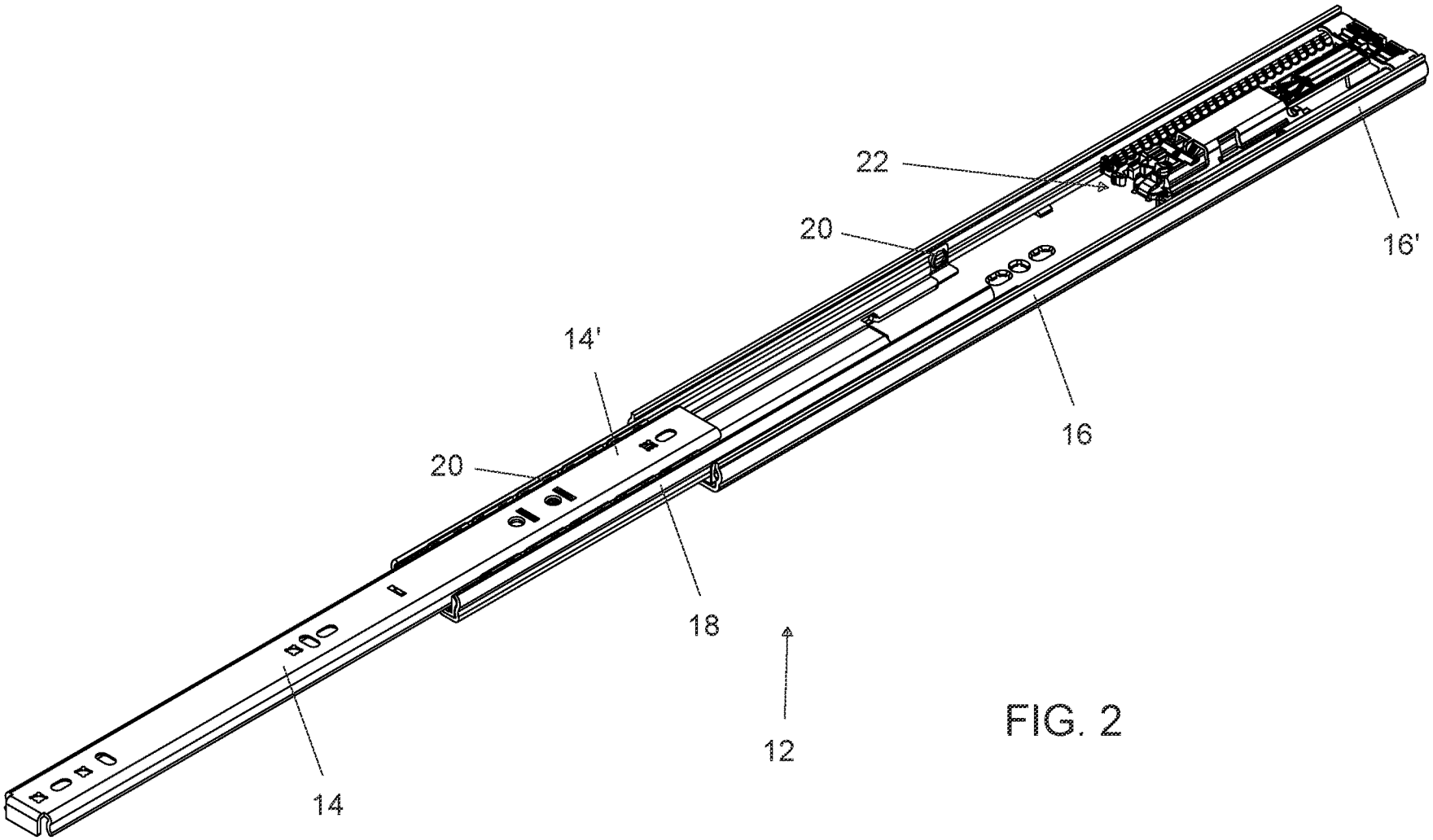
FIG. 2 is a top perspective view of a drawer slide assembly of FIG. 1 in a fully extended, open position.
Figure 3:
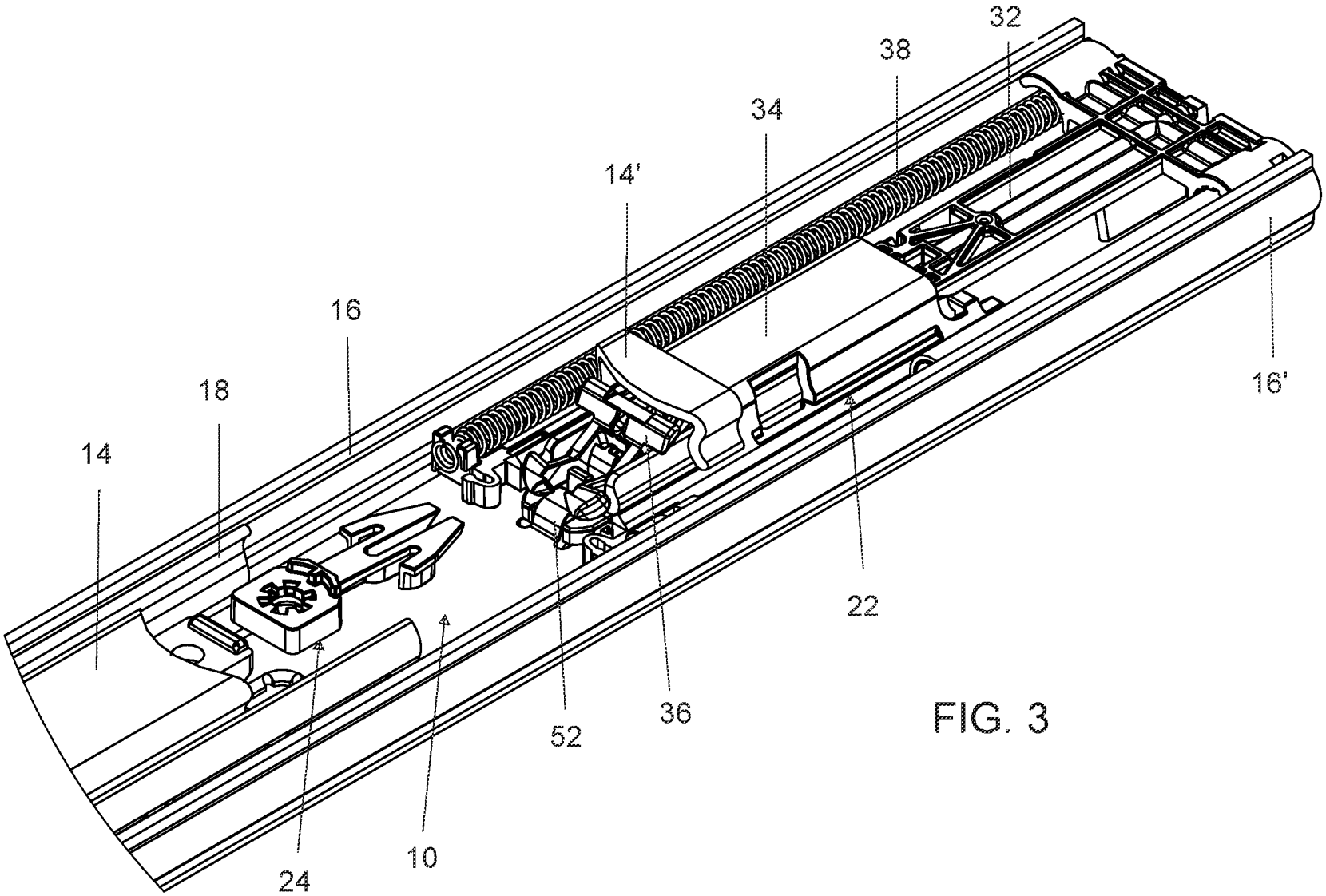
FIG. 3 is an enlarged, top perspective view showing an inner end of the drawer slide assembly of FIG. 1 with a portion of the inner drawer slide member cutaway and the catch of the self-closing mechanism in an unlocked position, just after disengagement from or prior to engagement with the latch.
Figure 5:
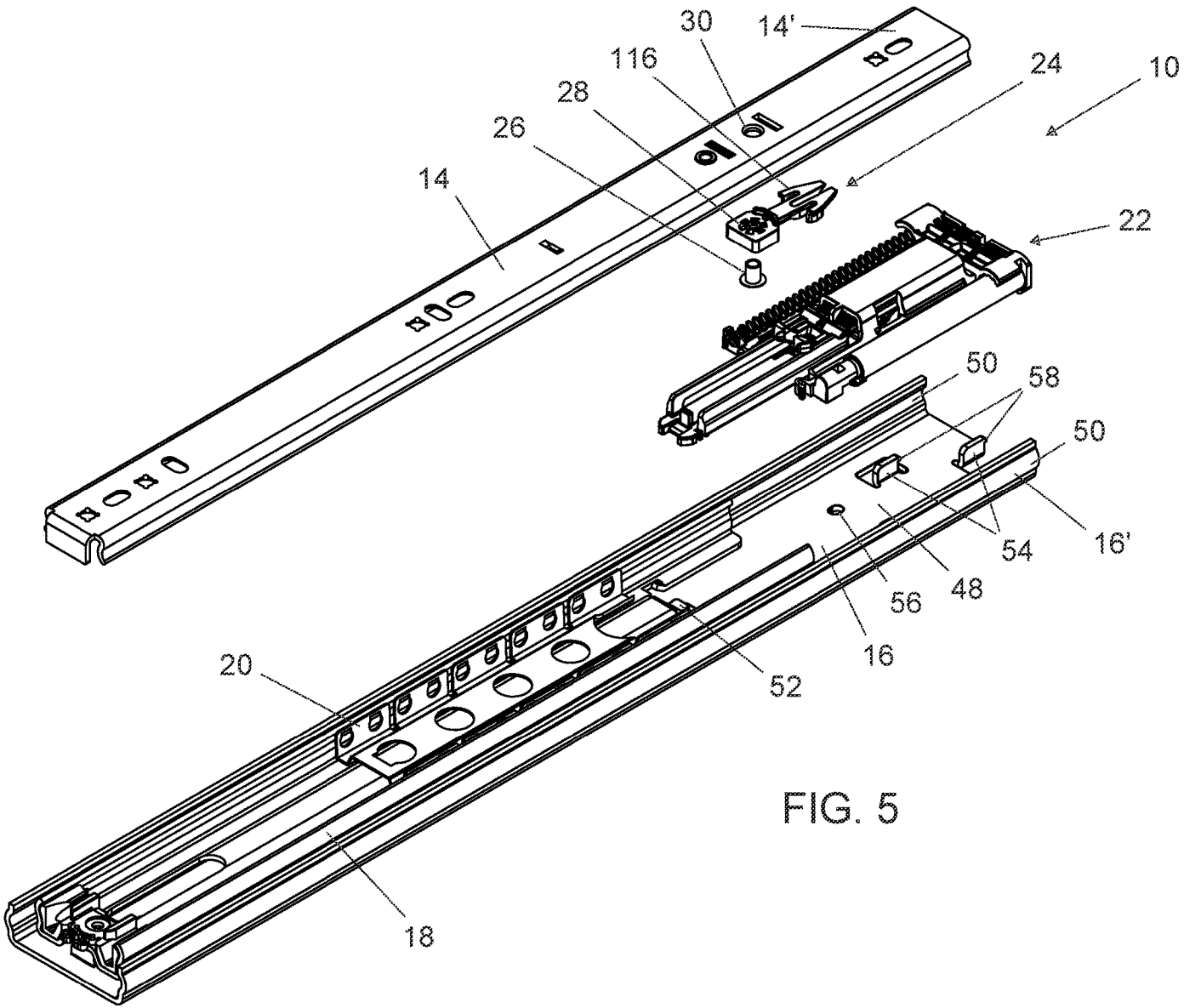
FIG. 5 is an exploded top perspective view of the drawer slide assembly of FIG. 1 with the inner slide member, latch and self-closing mechanism of the closing device exploded away from the outer slide member.

It will be appreciate that for this example, the drawer slide 12 may have the first slide member 14 mounted to a drawer and the second slide member 14 mounted inside a cabinet to the surface of a side wall. The third slide member 18 is coupled to and disposed between the respective first and second drawer slide members 14 and 16, and the slide members are slidably movable relative to each other by use of bearings 20 therebetween (the bearing retainer is shown for convenience without the ball bearings). For example, as seen in FIGS. 2 and 5, it will be appreciated that bearings 20 are located between the first and third slide members 14 and 18, and between the second and third slide members 16 and 18. In this example, the bearings 20 preferably are of the ball bearing type, and held in a retainer assembly. However, it will be appreciated that the slidable engagement may be achieved with other types of bearings, such as roller bearings, or solid bushings that also may be referred to as bearings, and alternatives may be made of various materials, such as plastic, metal, or other suitable materials or the like. Also, slidable engagement between the respective drawer slide members 14 and 18, and drawer slide members 16 and 18, may be but need not be of the same type. The drawer slide members 14, 16 and 18 preferably are constructed of steel or other suitable materials.

Figure 6:
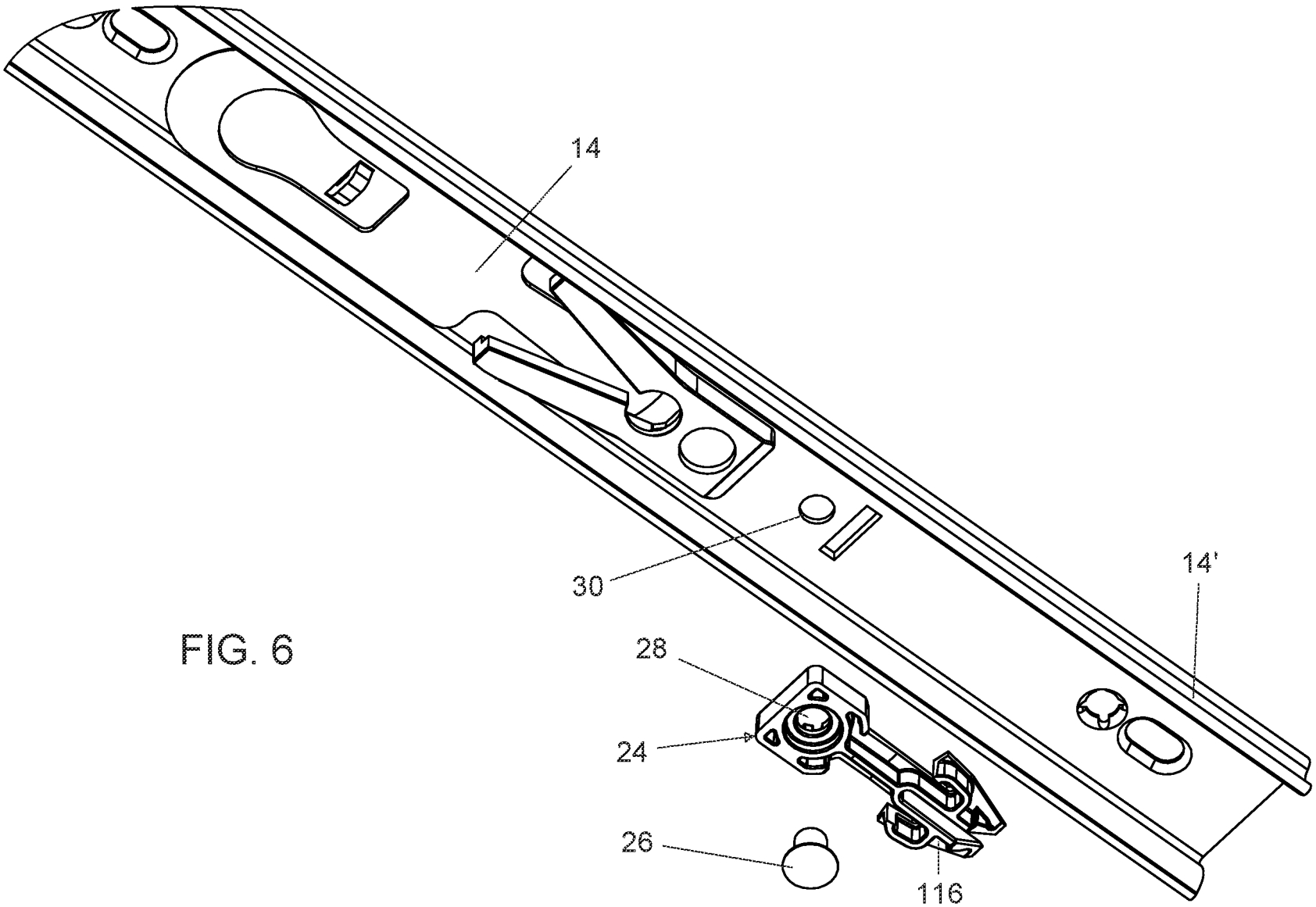
FIG. 6 is an exploded bottom perspective view of the inner end of the inner slide member of the drawer slide assembly of FIG. 1 with the latch exploded away from the inner slide member.
Figure 7:
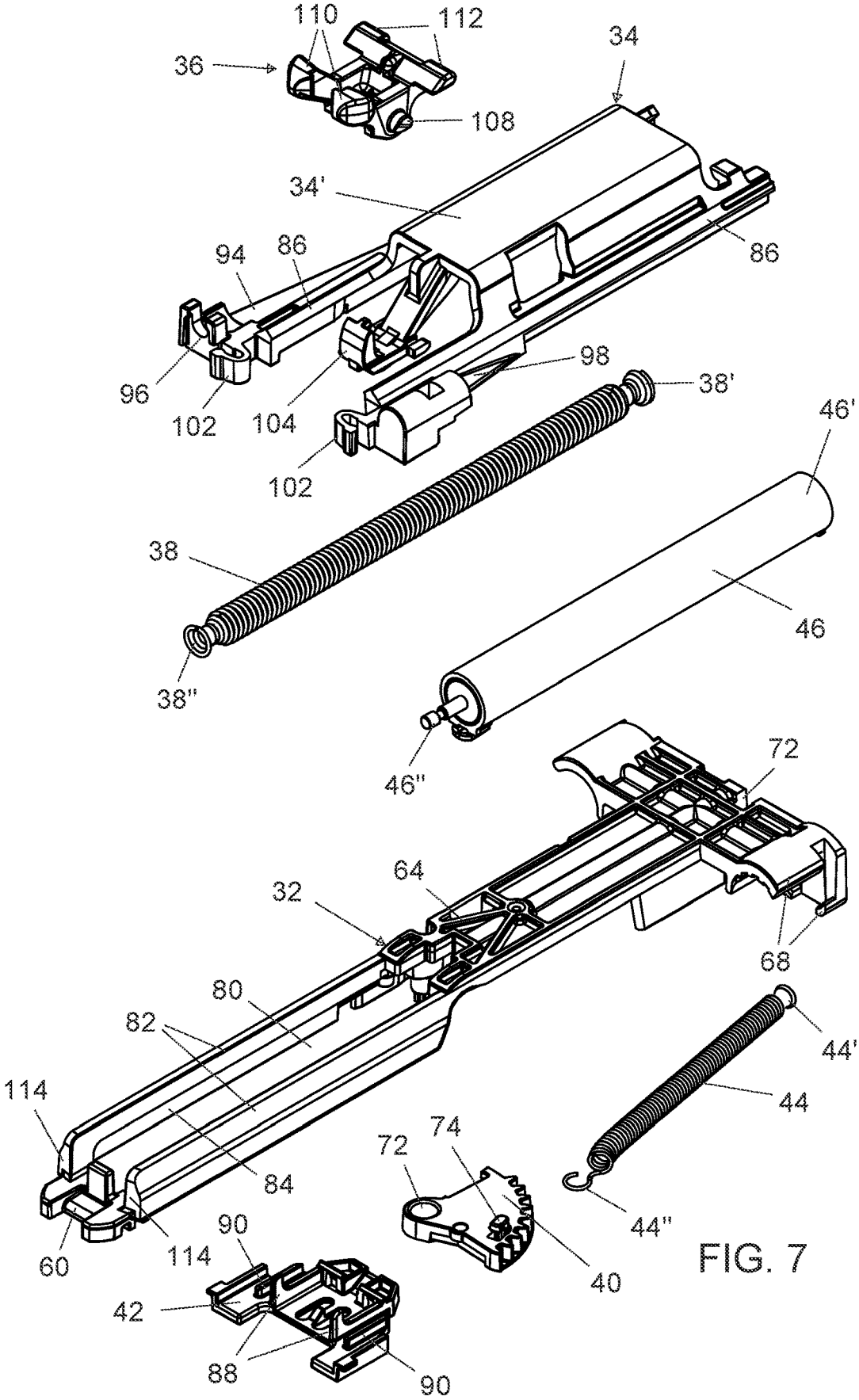
FIG. 7 is an exploded top perspective view of the self-closing mechanism of the closing device of the drawer slide assembly of FIG. 1.
Figure 8:
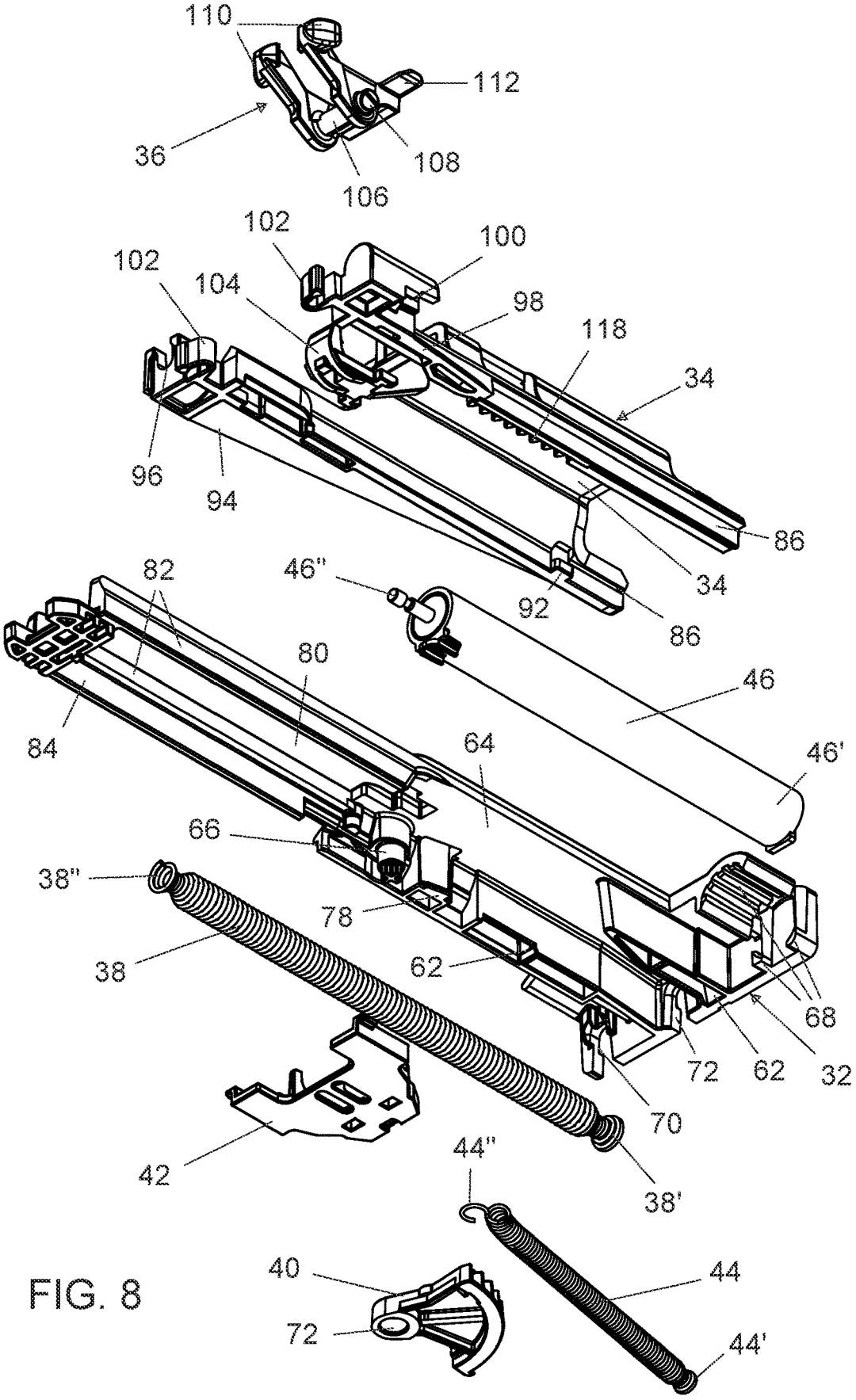
FIG. 8 is an exploded bottom perspective view of the self-closing mechanism of the closing device of the drawer slide assembly of FIG. 1.

As may be seen in FIGS. 3, 5 and 9A-9C, the closing device 10 includes a self-closing mechanism 22 and a latch 24. As may be seen in FIGS. 2-5, the self-closing mechanism 22 is coupled to the outer or second drawer slide member 16 near a first end 16', which will be referred to herein as the proximal end. The mounting will be described further herein. As seen in FIGS. 5 and 6, the latch 24 is coupled to the first drawer slide member 14 near a first end 14', which similarly will be referred to herein as the proximal end. In this example, the latch 24 is coupled to the first drawer slide member 14 by a rivet 26 that extends through an aperture 28 in the latch 24 and an aperture 30 in the first slide member 14, spaced from the first end 14'. The location of the latch 24 spaced a distance from the first end 14' of the inner slide member 14 advantageously permits use of longer bearing assemblies, and therefore, a greater length of the slide members 14 and 18 that overlap and are subject to the bearings 20, relative to prior art structures having a latch located at or extending from the end of the inner slide member. Having the first slide member 14 pass over the self-closing mechanism 22 also permits use of a more robust latch 24, relative to the pin style latches in lighter duty prior art self-closing drawer slides wherein a J-shaped slot typically is provided at or beneath a rear end of the first drawer slide member to move the pin in a prescribed pattern to engage or release from a closing device. The more robust latch of the present disclosure is advantageous for capacity, durability and reliability purposes.

First end 16' of the second drawer slide member 16 normally may be installed along an inner side wall surface of a cabinet body, extending from near the rear to near the front of the side wall. Having the second drawer slide member 16 mounted to the side wall of the cabinet body and the first drawer slide member 14 mounted to the drawer provides a particularly compact mounting arrangement that is not viewable by a user while the drawer is in the closed position within the cabinet.

More specifically, as may be seen in FIGS. 3-5, 7-11C with respect to the example closing device 10, the self-closing mechanism 22 of the closing device 10 preferably includes: a base 32, a rack body 34, a catch 36, a first biasing member 38, a gear 40, a rack tie 42, a second biasing member 44 and, optionally, a damper 46. The latch 24 that interacts with the catch 36 of the self-closing mechanism 22. The base 32, rack body 34, catch 36, gear 40, rack tie 42 and latch 24 preferably are constructed of molded plastic, or other suitable materials, and each may be formed as a single piece, as shown, or of an assembly of components. The first biasing member 38 and second biasing member 44 preferably are constructed as coiled, linear rate extension springs, although it will be appreciated that other biasing member configurations may be utilized, such as for example a torsion spring for the second biasing member.

The base 32 extends longitudinally, in the same direction that the drawer slide 12 extends. In this example, the base 32 is configured to be readily attachable to the second or outer slide member 16 proximate its proximal end 16', to facilitate simple, rapid and secure mounting that also reduces the potential for interference with other components of the assembly. The second slide member 16 includes a web 48 between outer bearing rails 50, with the web 48 providing a front mounting tab 52 and rear mounting tabs 54, preferably with the front and rear mounting tabs 52, 54 being integrally formed from and extending out of the plane of the web 48. The web 48 also includes an aperture 56 located between the front and rear mounting tabs 52, 54. The front mounting tab 52 extends away from the web 48 toward the first slide member 14 and then rearward toward the first end 16' of the second slide member 16. The rear mounting tabs 54 extend away from the web 48 toward the first slide member 14 and have a rearward extending protrusion 58. The rack tie 42 is to be positioned between the base 32 and the web 48 of the second slide member 16.

The base 32 includes a front locating member 60, and rear locating walls 62. The base 32 also includes a central portion 64 having a protruding post 66. These features permit the rack tie 42 to be positioned between the base 32 and the web 48, and then the base 32 to readily snap into a mounted position at the first end 16' of the second slide member 16. This is accomplished by first moving the front locating member 60 of the base 32 into position between the front mounting tab 52 and the web 48, and then moving the post 66 to extend into the aperture 56 in the web 48, and moving the rear of the base 32 toward the web 48 until the rear locating walls 62 of the base 32 engage mounting tabs 54 and move past the rearward extending protrusions 58 and snap into a locked position between the protrusions 58 and the web 48. While this example provides a particularly advantageous snap fit connection of the self-closing mechanism 22 to the second slide member 16, one of ordinary skill in the art will appreciate that the base 32 may be coupled to the second slide member 16 in numerous different ways, including by use of separate fasteners, adhesives or other interlocking features on the base or slide member.

The rear end of the base 32 includes a socket 68 that receives a rear end 46' of the optional damper 46, a first slot 70 that receives a rear end 38' of the first biasing member 38, and a second slot 72 that receives a rear end 44' of the second biasing member 44. The gear 40 has an aperture 72 for pivotal coupling to the post 66. The gear 40 also includes a tab 74 for coupling to an opposed second end 44" of the second biasing member 44, which biases the gear 40 to rotate fully rearward, wherein a rear edge 76 of the gear 40 extends below a locating tab 78 on the base 32. This configuration permits the gear 40 to be held in place during handling of the self-closing mechanism 22, prior to installation on the second slide member 16, because the second biasing member 44 biases the gear 40 to the rearward position wherein the rear edge 76 of the gear 40 is captured by the tab 78. The base 32 also includes a channel 80 that extends forward and is bounded by side walls 82, with each side wall 82 having a longitudinally extending undercut slot 84.

The rack body 34 straddles and slidably engages the base 32. The rack body 34 includes a pair of longitudinal guide rails 86, and a top wall 34' that extends between and is connected to the guide rails 86. The guide rails 86 are spaced apart from the side walls 82 of the base 32 by upstanding tabs 90 of the rack tie 42. The rack tie 42 further includes ribs 88 that locate the side walls 82 of the base 32 between the ribs 90 and the upstanding tabs 88 to help locate and stabilize the front of the base 32, while also separating the guide rails 86 of the rack body 34 from the side walls 82 of the base 32 and from contact with the web 48, promoting smooth sliding of the rack body 34 relative to the base 32 and the second slide member 16. One of the guide rails 86 of the rack body 34 includes an inward extending retention tab 92 that captures a respective side wall 82 of the base 32 to assist in keeping the rack body 34 slidably engaged with the base 32, while under the tension of the first biasing member 38. The opposed guide rail 86 of the rack body 34 includes an inward extending retention tab 92' that together with the top wall 34' of the rack body 34 slidably captures the base 32 and helps to stabilize the movement of the rack body 34 relative to the base 32.

As may be seen in FIGS. 7, 8 and 10A-10C, the rack body 34 includes a front biasing member mounting arm 94 having a slot 96 that receives an opposed second end 38" of the first biasing member 38. As may be seen in FIGS. 8 and 11A-11D, the rack body 34 also includes a front damper mounting arm 98 having a slot 100 that receives a front end 46" of the optional damper 46. In this example, the rear end 46' of the damper 46 is the rear of the damper cylinder, while the front end 46" of the damper 46 is the front end of the damper rod. However, it will be appreciated that the components could be configured to mount a damper in the reverse orientation. Also, the example damper 46 dampens movement of the rack body 34 in at least one direction, such as would be advantageous by damping in the closing direction by permitting free movement in the opening direction. The rack body 34 further includes front cushions or bumpers 102 that engage a rear end 18' of the third slide member 18, to help provide quiet and comfortable operation of the drawer slide 12.

A cradle 104 extends from the rack body 34 downward, forward and generally toward the web 48 of the second slide member 16. As may be appreciated in FIGS. 7-8 and 10A-10C, the catch 36 is received by and pivotally coupled to the cradle 104 by a pivot axle 106 on the catch 36. Lateral extensions or ends 108 of the pivot axle 106 extend laterally outward from the catch 36 and slidably engage the longitudinally extending undercut slots 84 on the side walls 82 of the base 32.

The catch 36 further includes front portions 110 that are located above the pivot axle 106 and extend forward and laterally outward, while rear portions 112 extend laterally outward from above and behind the position of the pivot axle 106. The front portions 110 are in a locked position when the catch 36 is moved to the front of the channel 80 and the catch 36 is pivoted forward and downward, so as to move the front portions 110 toward the web 48 of the second drawer slide member 16, placing the front portions 110 forward of and engaging the front ends 114 of the side walls 82 of the base 32. As the catch 36 and rack body 34 move forward, they are subjected to a linearly increasing biasing force from the first biasing member 38. In the locked position, the catch 36 is under the influence of the tension in the first biasing member 38, which is at its maximum, and the catch 36 is in an armed state, best seen in FIGS. 3, 4, 9C and 10C.

Figure 9A:
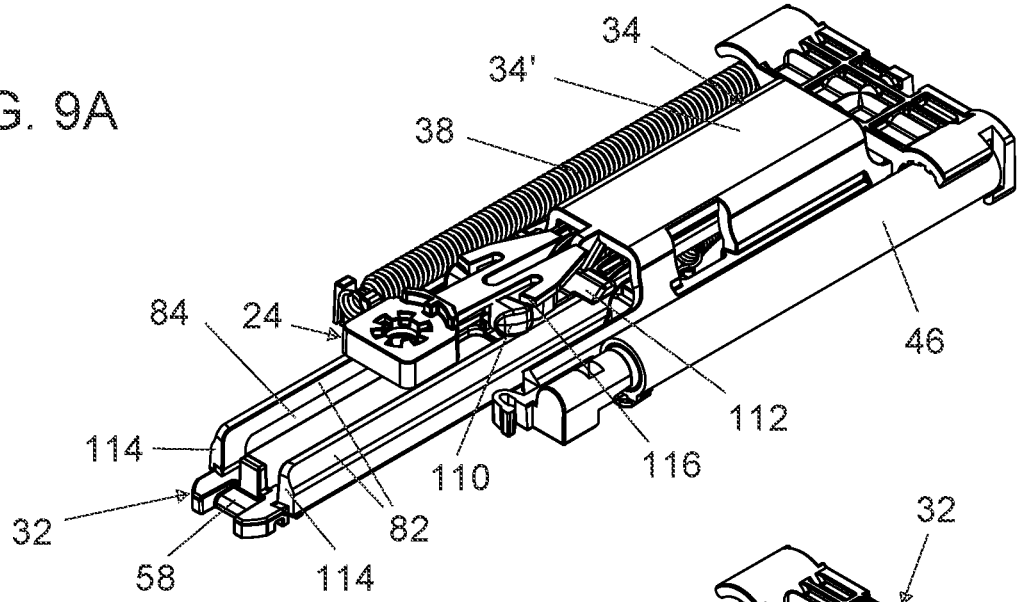
FIG. 9A is a top perspective view of the latch and the self-closing mechanism of the closing device of the drawer slide assembly of FIG. 1 with the catch and latch at the fully closed position.
Figure 9B:
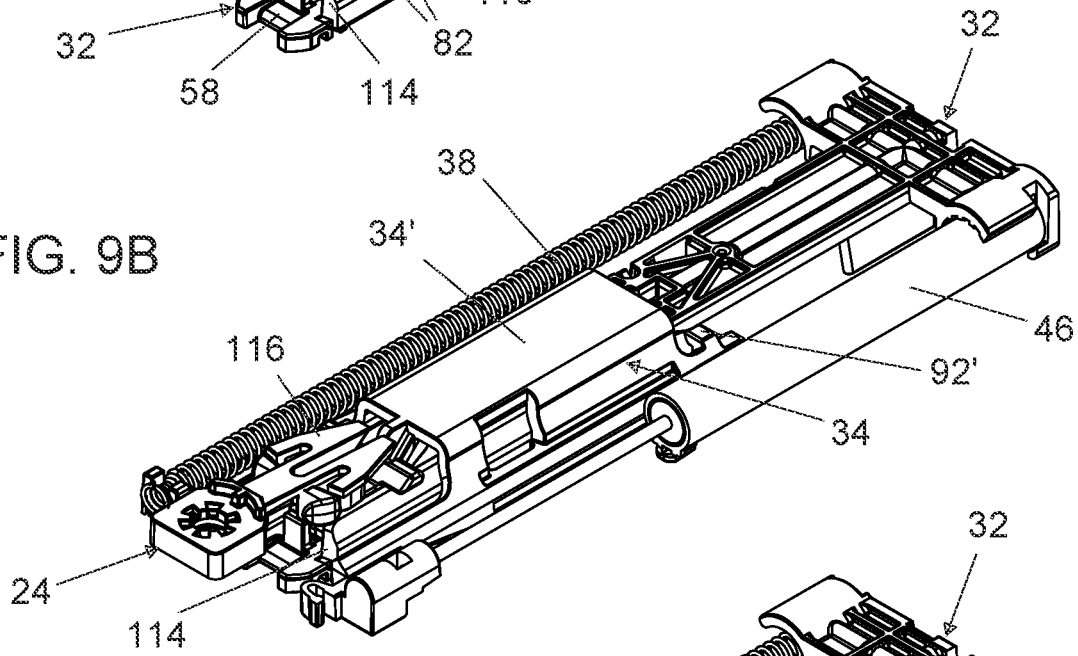
FIG. 9B is a top perspective view of the latch and self-closing mechanism of the closing device shown in FIG. 9A, with the catch in an unlocked position just prior to releasing the outward moving latch, or just after having engaged the inward moving latch and reaching the unlocked position.
Figure 10A:
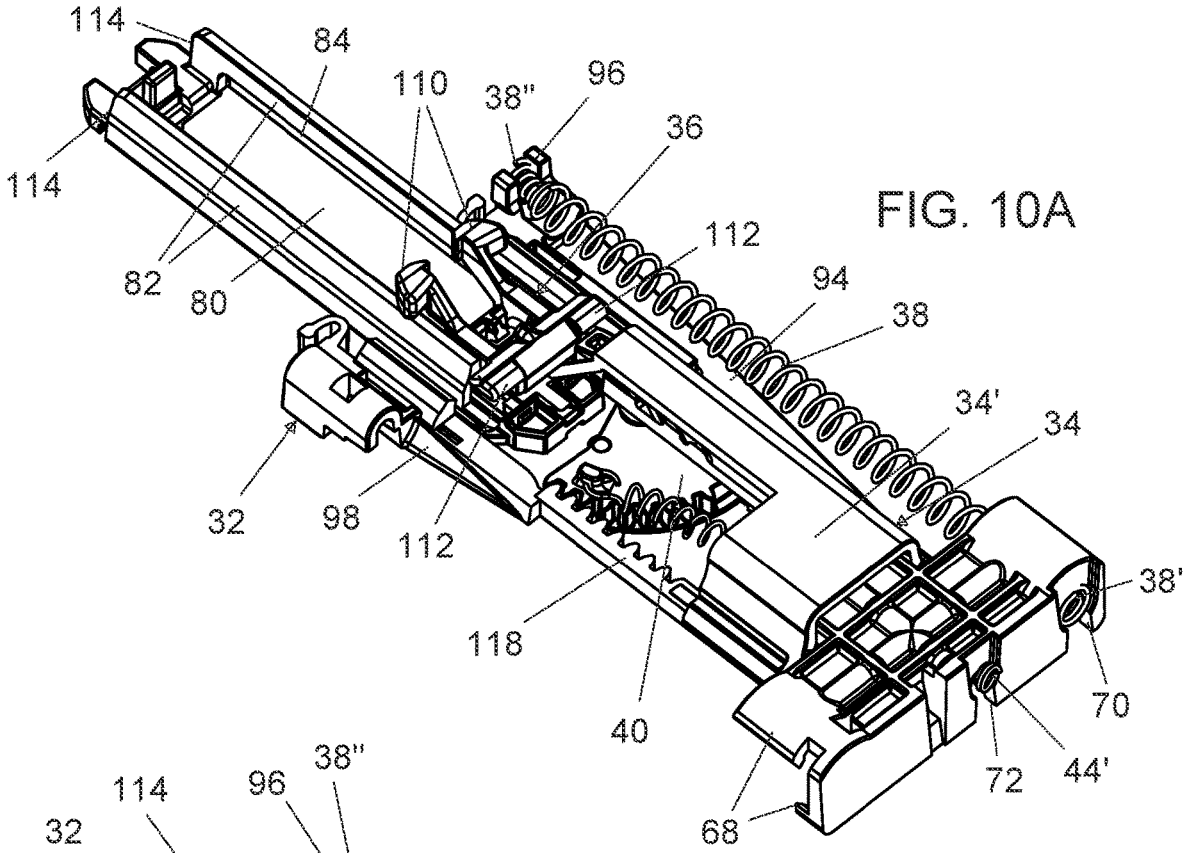
FIG. 10A is a top perspective view of the self-closing mechanism shown in FIG. 9A without a damper, and with a cutaway of a portion of the rack body and having the catch unlocked and corresponding to the fully closed position.
Figure 10B:
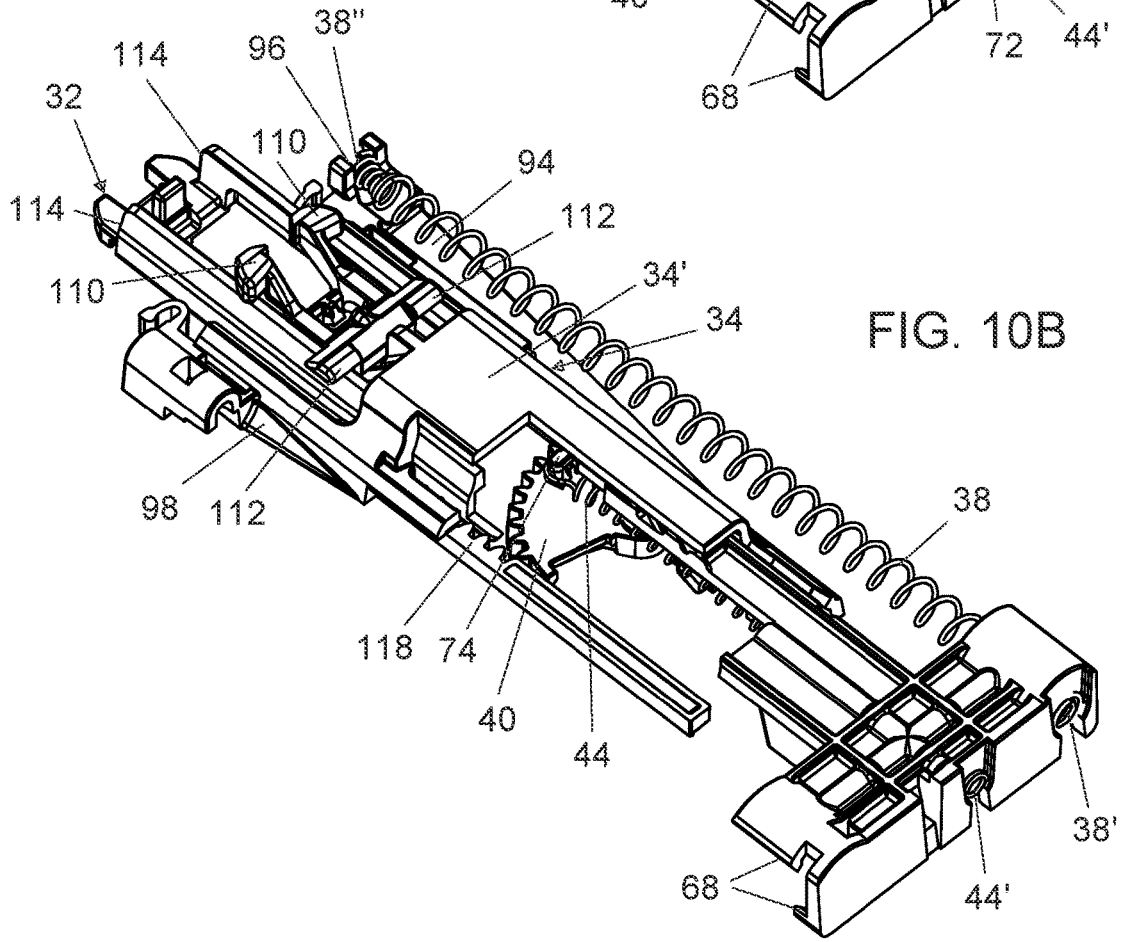
FIG. 10B is a top perspective view of the self-closing mechanism shown in FIG. 10A and having the catch in an unlocked intermediate position between the locked, open position and the unlocked closed position.

When the catch 36 is pivoted upward and rearward, such as may be seen in FIGS. 9B and 10B, so as to be released from the locked position, the catch 36 tilts rearward until the rear portions 112 slidably engage the top surfaces of the side walls 82 of the base 32. As will be appreciated in FIGS. 9A-9B and 10A-10B, in the unlocked position, the catch 36 is permitted to move forward and rearward within the channel 80, while the first biasing member 38 biases the rack body 34 to move rearward to a closed position, the axle 106 of the catch 36 remains pivotally positioned within the cradle 104 of the rack body 34, and the lateral extension or ends 108 of the pivot axle 106 remain within the undercut slots 84 of the side walls 82 of the base 32.

Figure 1:
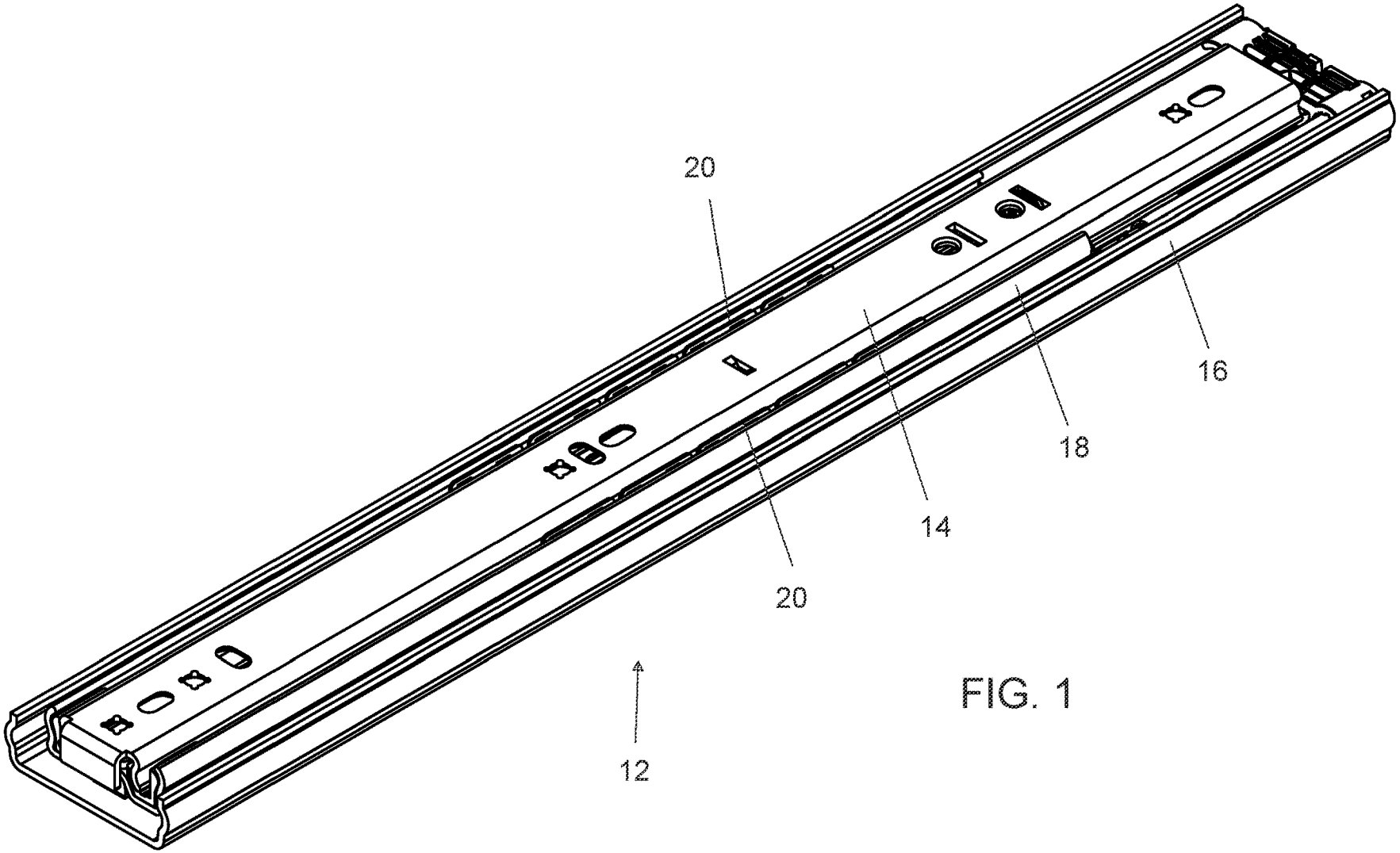
FIG. 1 is a top perspective view of a drawer slide assembly in a fully retracted, closed position and including an example closing device in accordance with the disclosure.

It will be appreciated that movement of the catch 36 is based on movement of and interaction with the latch 24 that is connected near the front end 14' of the first slide member 14. For example, when the drawer slide 12 is in a fully retracted closed position, such as is shown in FIG. 1, a head 116 of the latch 24 is positioned rearward of the front portions 110 of the catch, as may be seen in FIG. 9A. This, in turn, corresponds to the position of the catch 36 of the self-closing mechanism 22 in the additional FIGS. 10A, 11A and 13A. With the catch 36 at the rearward end of its travel, both the rear portions 112 and the front portions 110 are located above the side walls 82 of the base 32.

The present disclosure further addresses and overcomes disadvantageous force relationships by providing force modulation via interaction of the gear 40 with a rack 118 along an inner side of one of the guide rails 86 of the rack body 34. The gear 40 and rack 118 each include teeth, and the engagement of the rack 118 with the gear 40 causes pivoting of the gear 40 to drive movement of the rack body 34 while the gear 40 is under the influence of the second biasing member 44. For durability and friction reduction purposes, the rack 118 is overmolded with a low friction material along the surfaces that engage the gear 40, including the teeth and the portion along which the gear 40 slides after disengagement with the rack 118. For instance, the material of the gear 40 may be acetal, while the material used for overmolding along the rack 118 may be nylon. It will be appreciated that other materials could be used.

Figure 4:
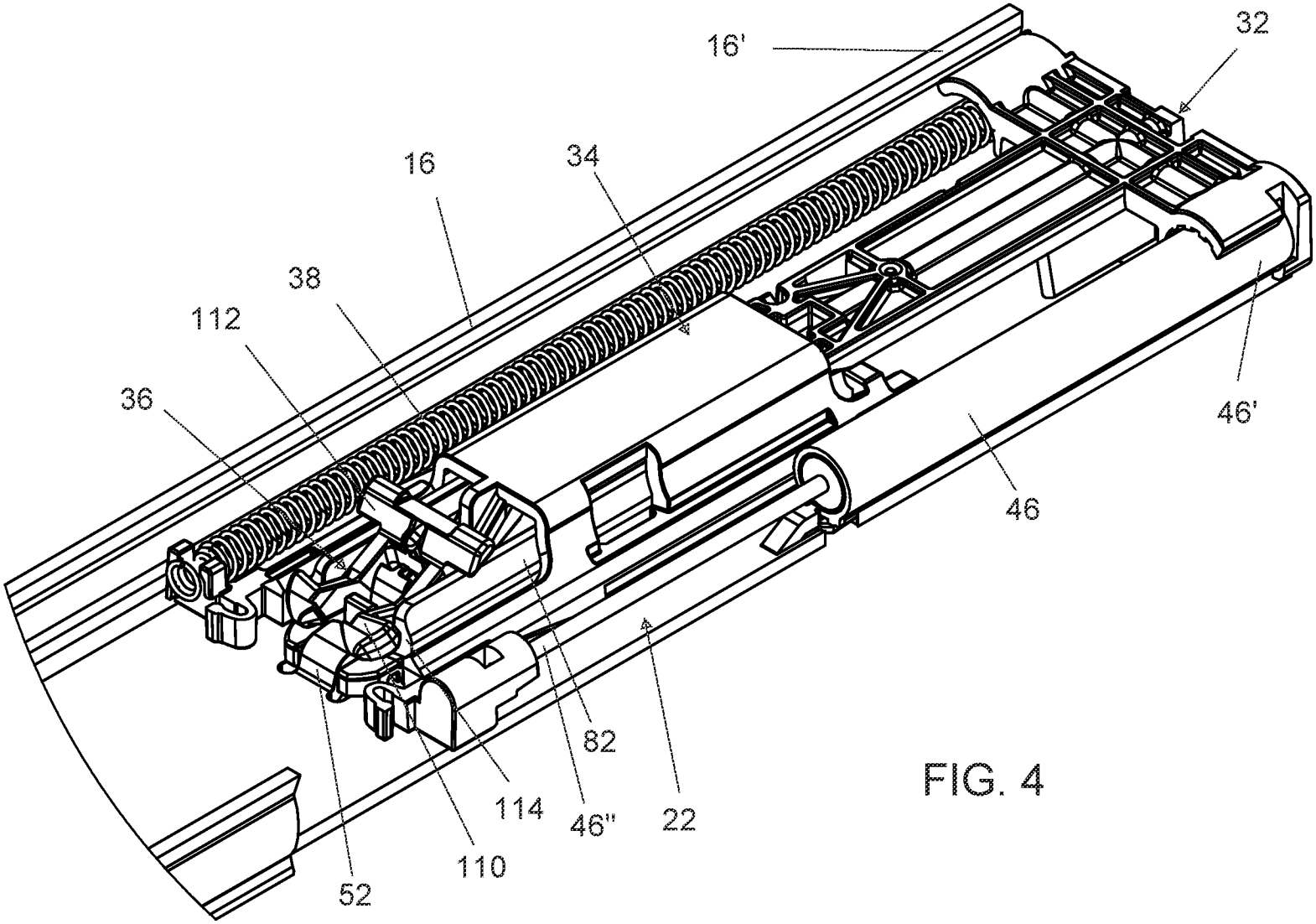
FIG. 4 is an enlarged, top perspective view showing an inner end of the outer drawer slide member of the drawer slide assembly of FIG. 1 with a side wall cutaway and the example self-closing mechanism of the closing device in the locked position.
Figure 9C:
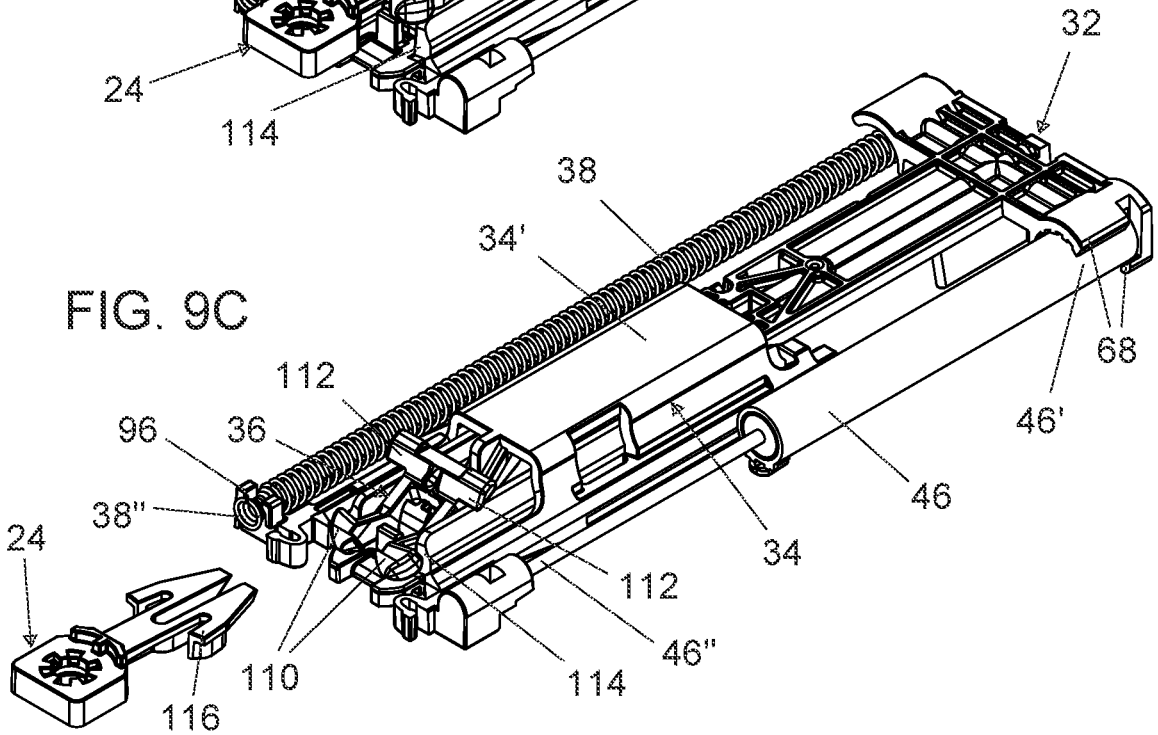
FIG. 9C is a top perspective view of the latch and self-closing mechanism of the closing device shown in FIGS. 9A and 9B, with the catch in the locked position just after releasing the outward moving latch, or just before engaging the inward moving latch.
Figure 10C:
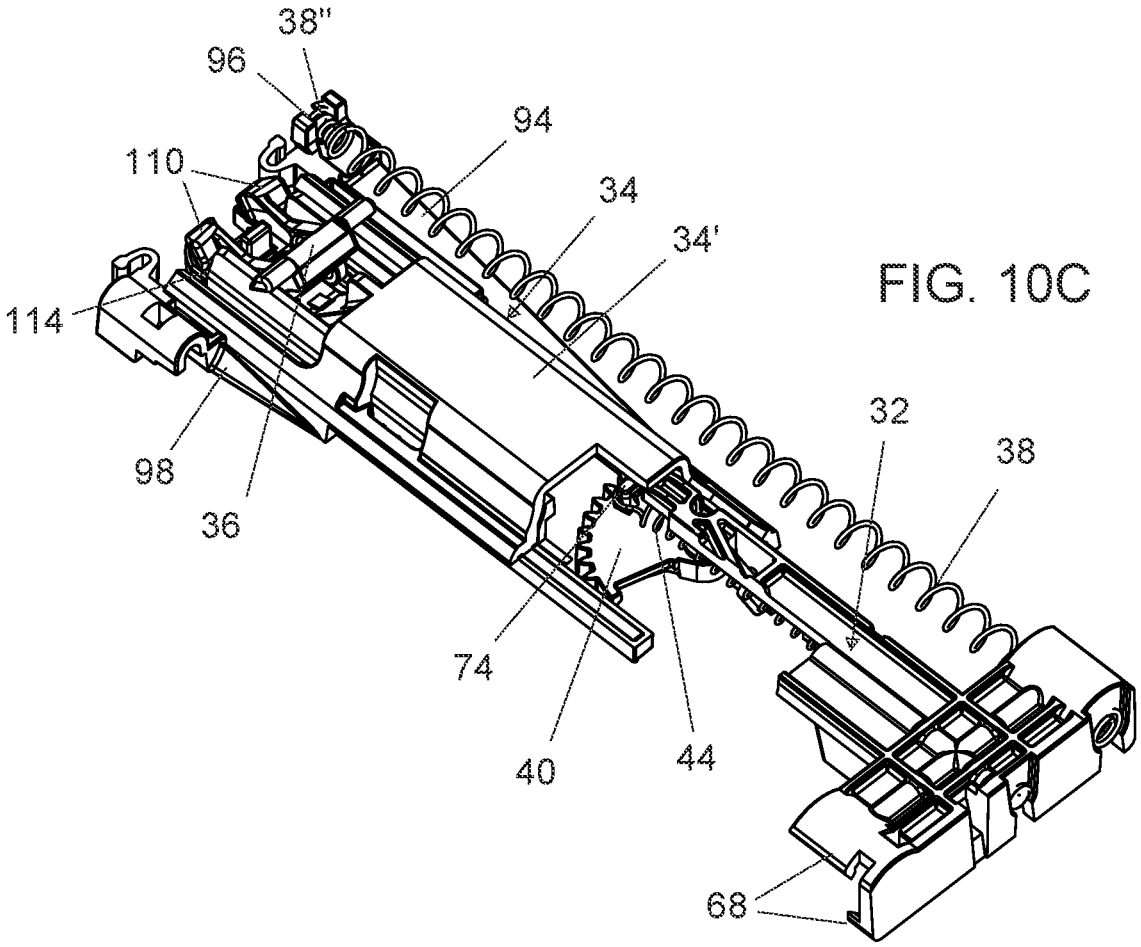
FIG. 10C is a top perspective view of the self-closing mechanism shown in FIGS. 10A and 10B, and having the catch in the locked position.
Figure 11A:
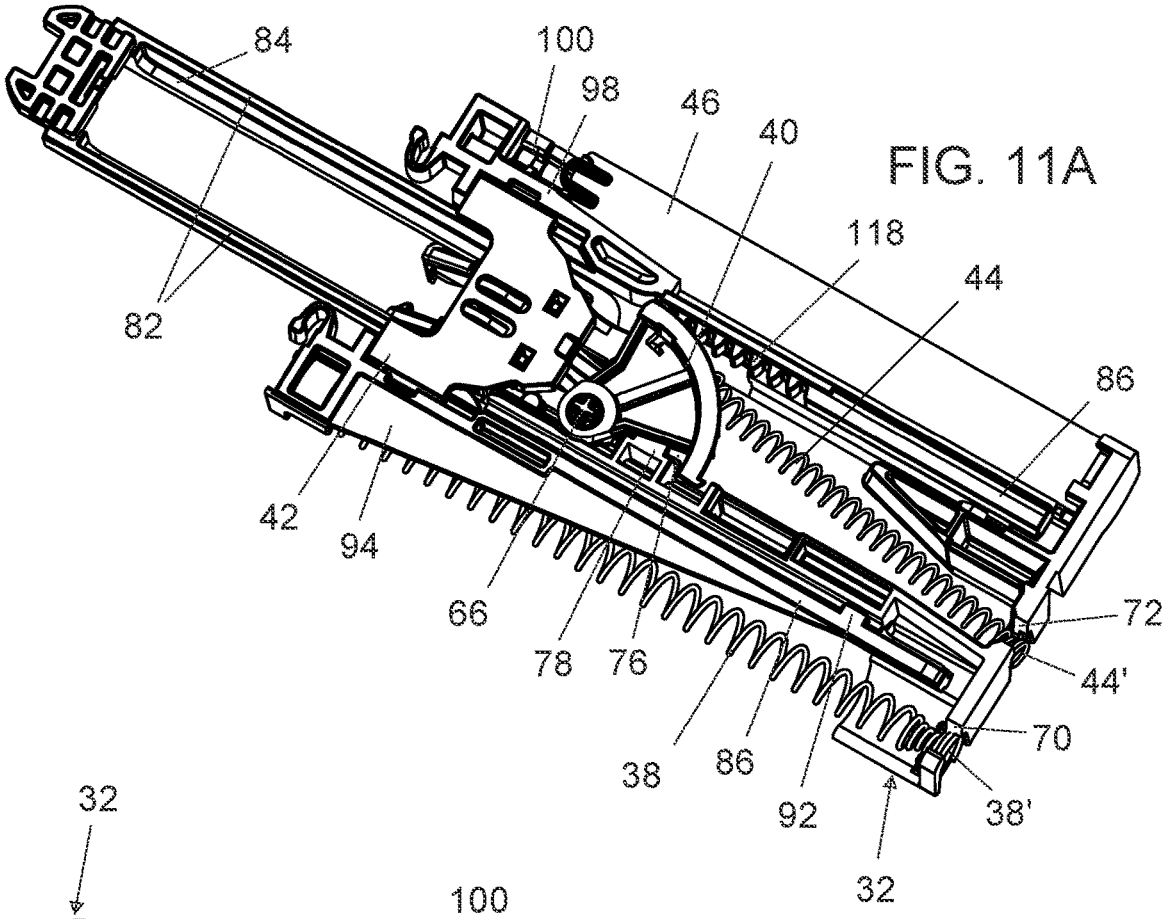
FIG. 11A is a bottom perspective view of the self-closing mechanism shown in FIG. 9A with the catch at the fully closed position.
Figure 11B:
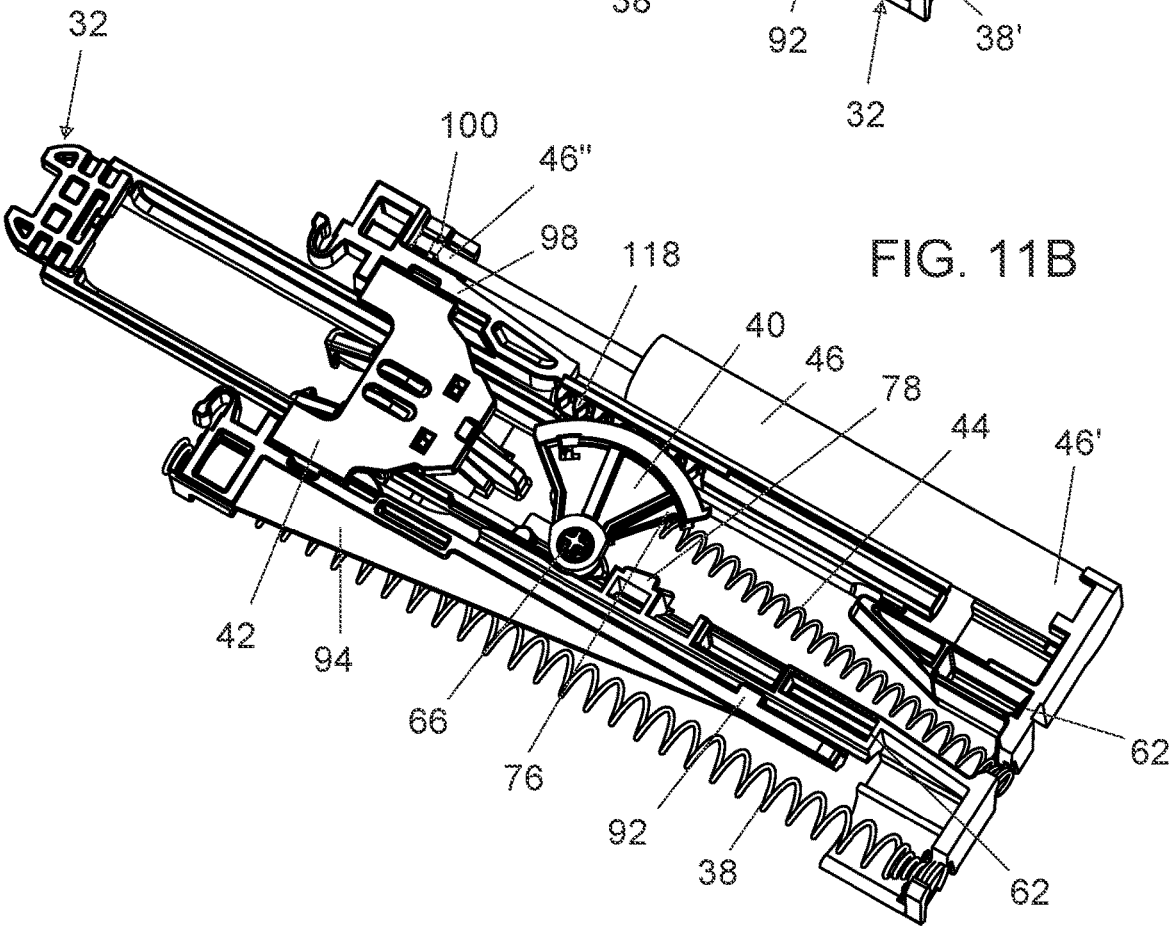
FIG. 11B is a bottom perspective view of the self-closing mechanism shown in FIG. 10B with the catch in the unlocked intermediate position.
Figure 11C:
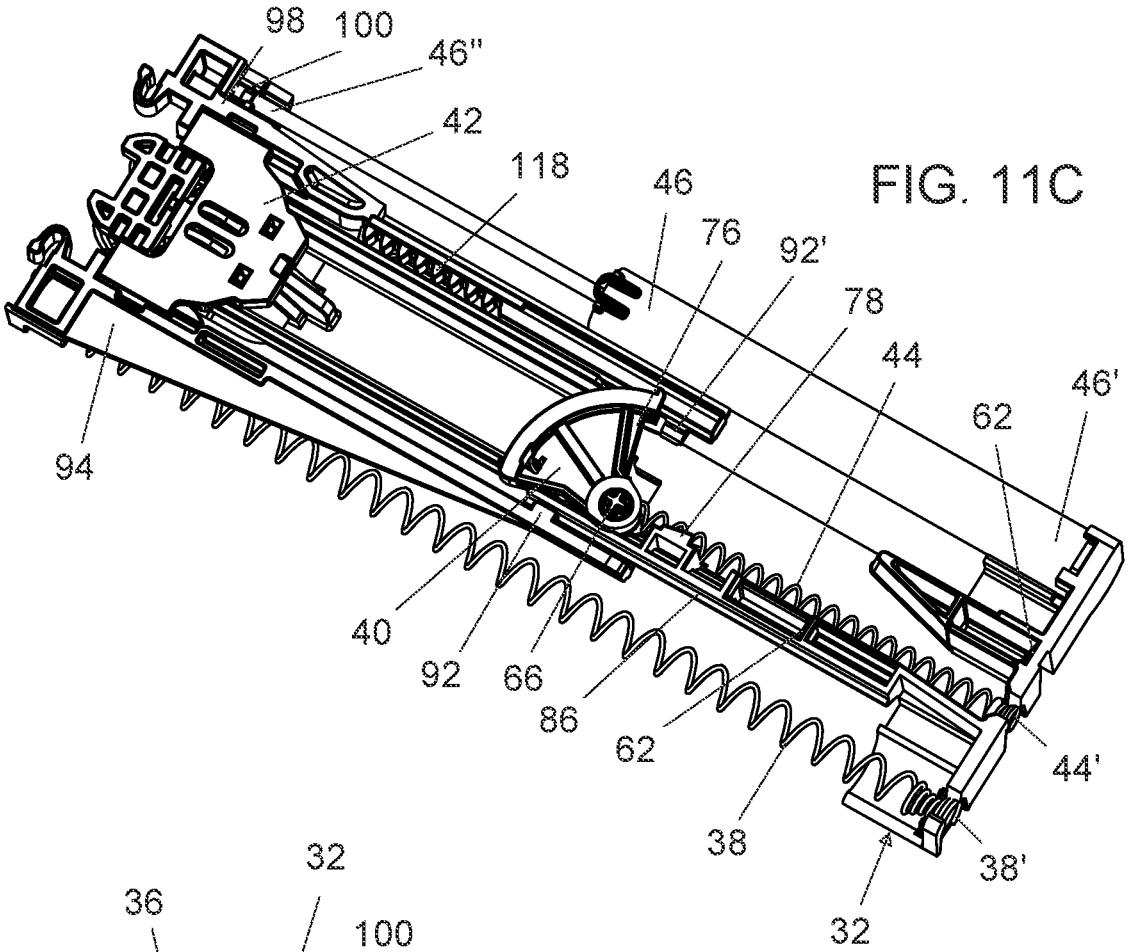
FIG. 11C is a bottom perspective view of the self-closing mechanism shown in FIG. 10C, and having the catch in the locked position, with the rack body having moved forward and the rack being disengaged from the gear.
Figure 11D:
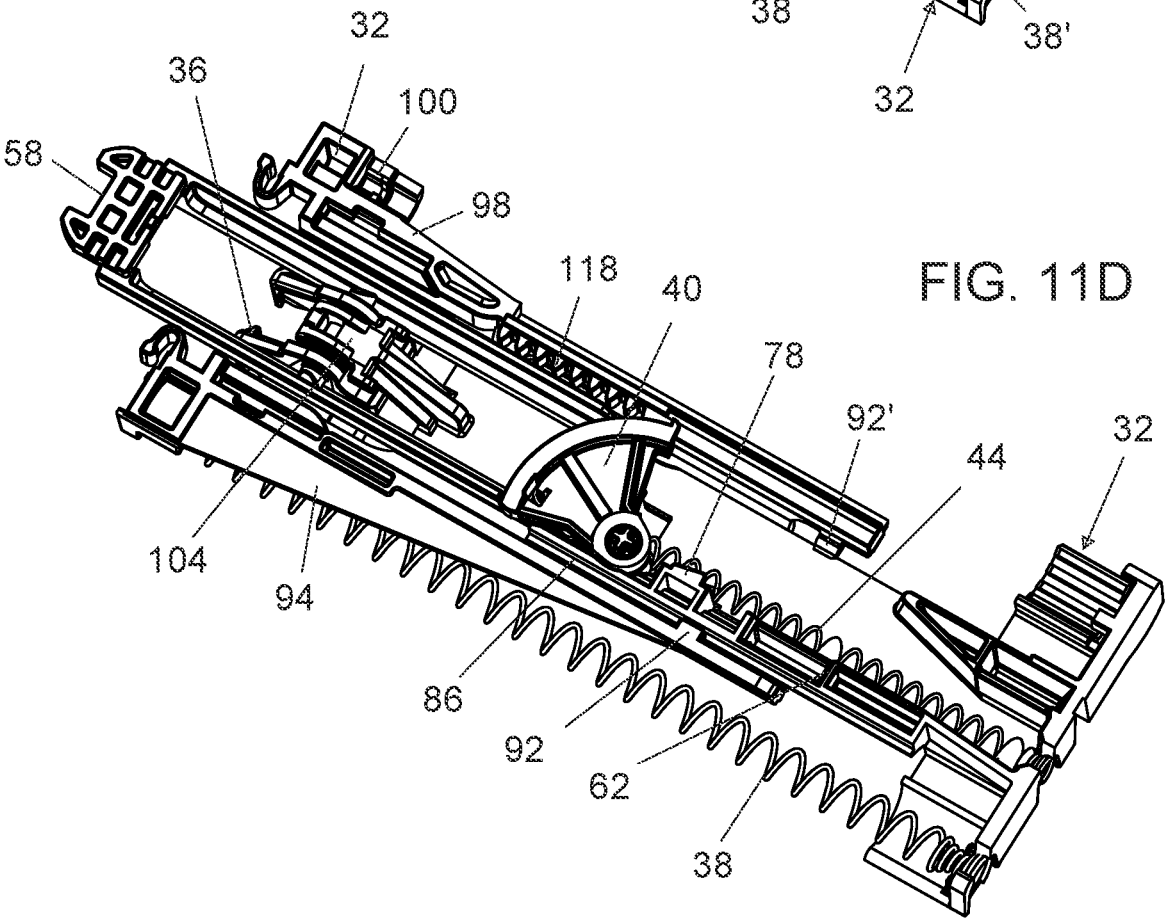
FIG. 11D is a bottom perspective view of the self-closing mechanism shown in FIG. 11C, having the catch in the locked position and with the rack tie removed for better viewing.
Figure 12A:
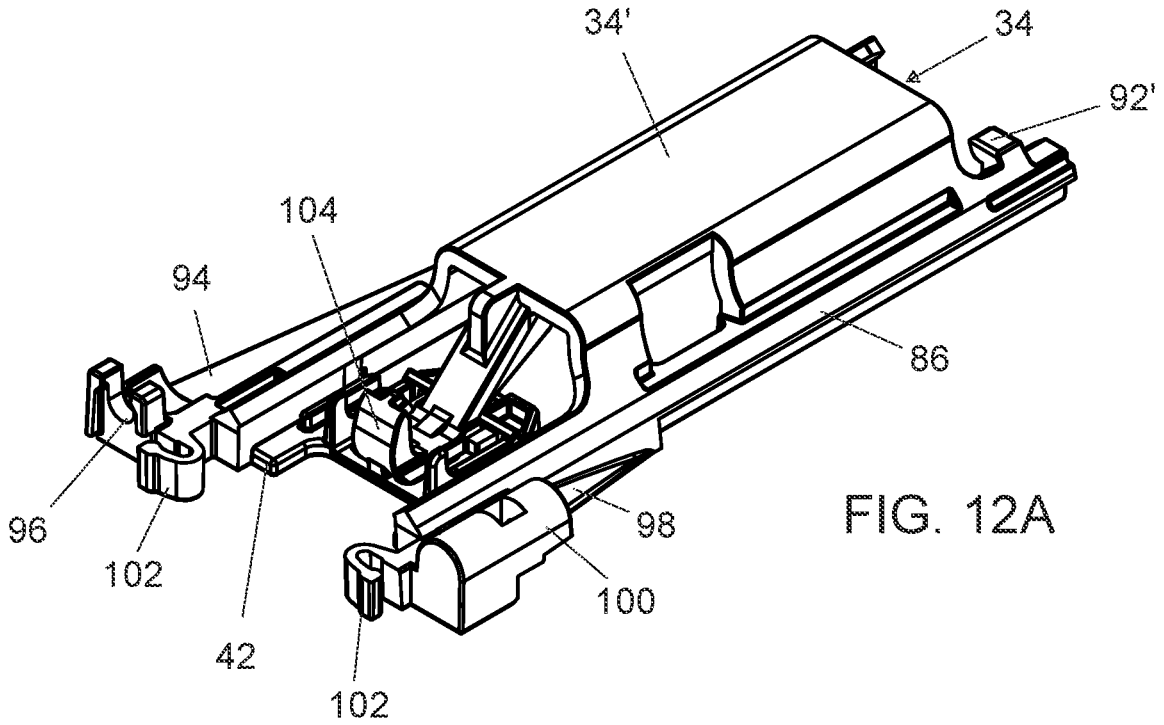
FIG. 12A is a top perspective view of the rack body and rack tie of the self-closing mechanism shown in FIG. 9A.
Figure 12B:
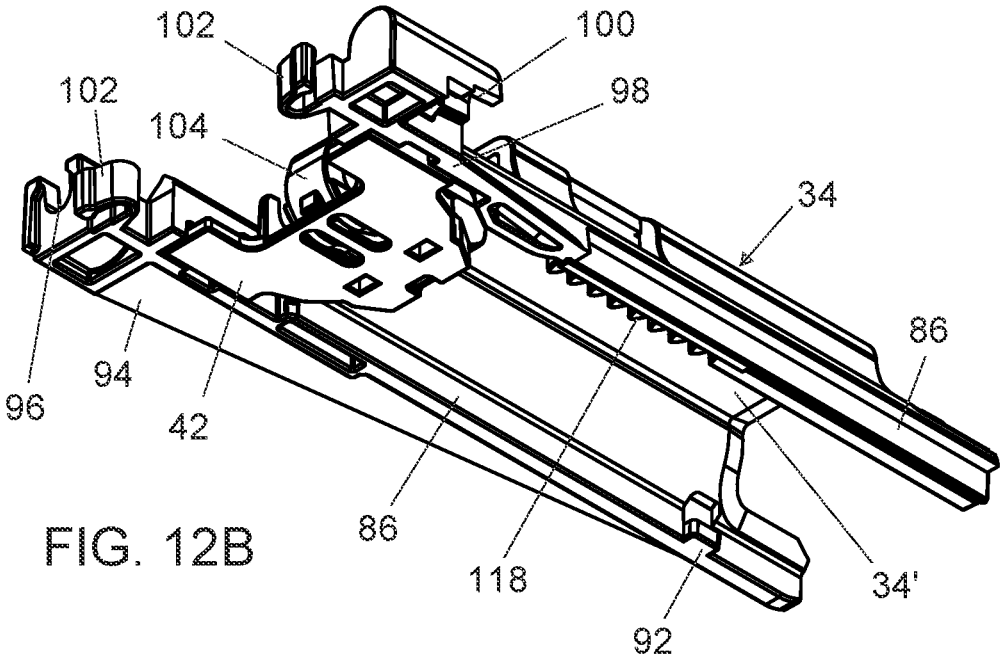
FIG. 12B is a bottom perspective view of the rack body and rack tie of the self-closing mechanism shown in FIG. 12A.
Figure 13A:
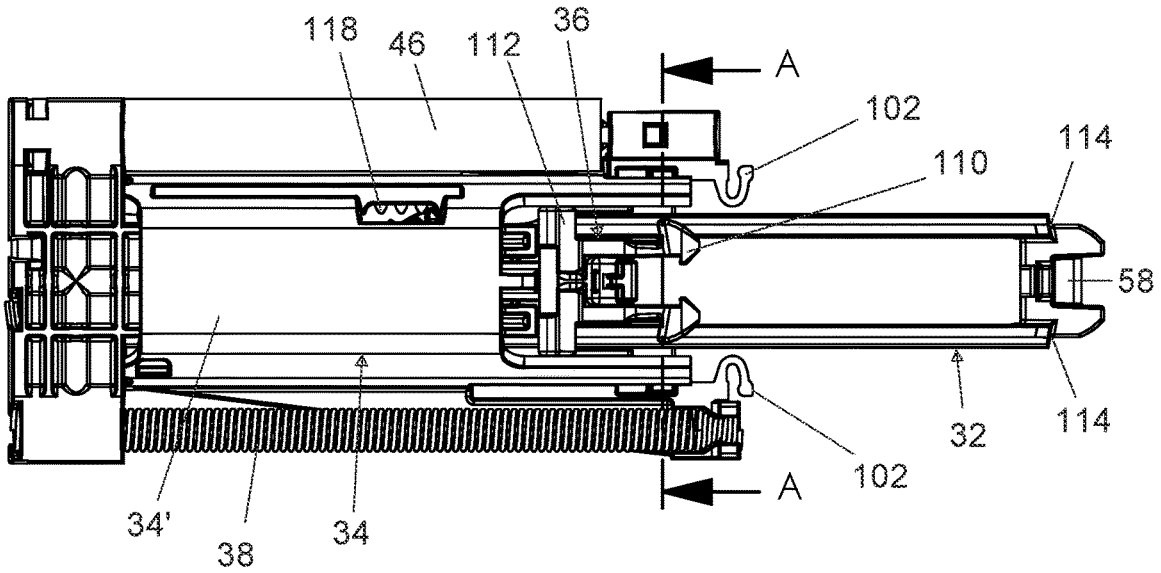
FIG. 13A is a top view of the self-closing mechanism shown in FIG. 9A.
Figure 13B:
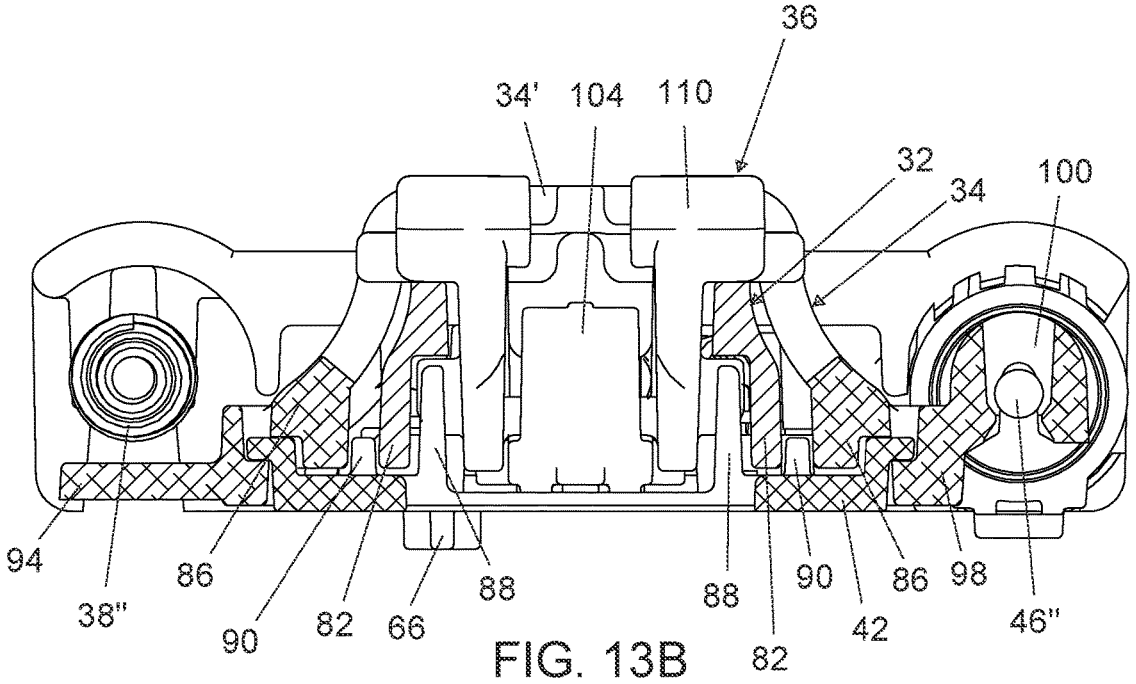
FIG. 13B is a front cross-section view of the self-closing mechanism taken at the section line AA shown in FIG. 13A.
Figure 14A:
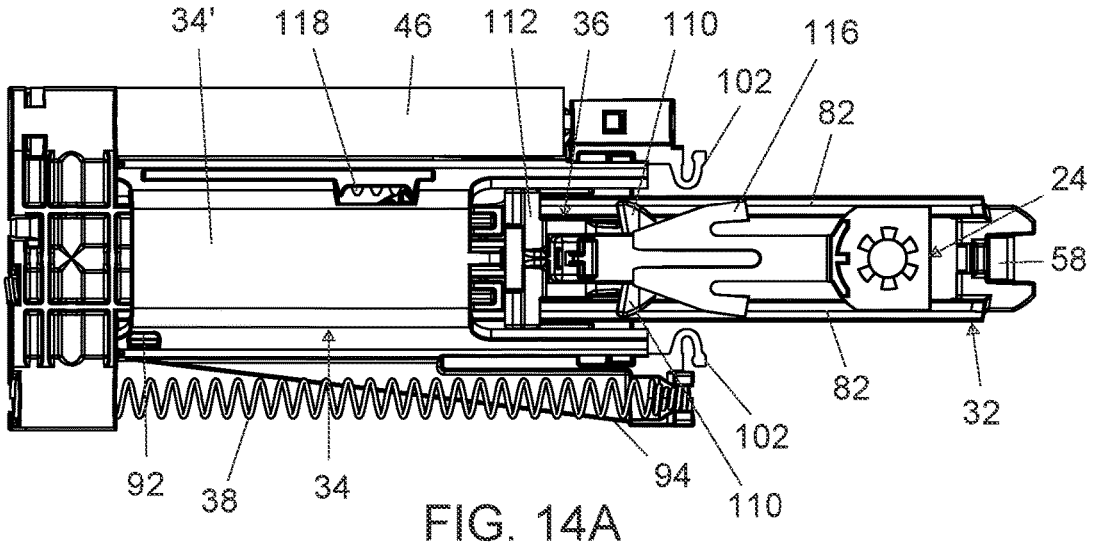
FIG. 14A is a top view of the self-closing mechanism shown in FIG. 9A, but with the latch approaching a bypass reset position, such as when the latch is ready to reengage the catch after the catch experienced a bypass condition in which it reached the closed position without the latch causing the catch to move to the closed position.
Figure 14B:
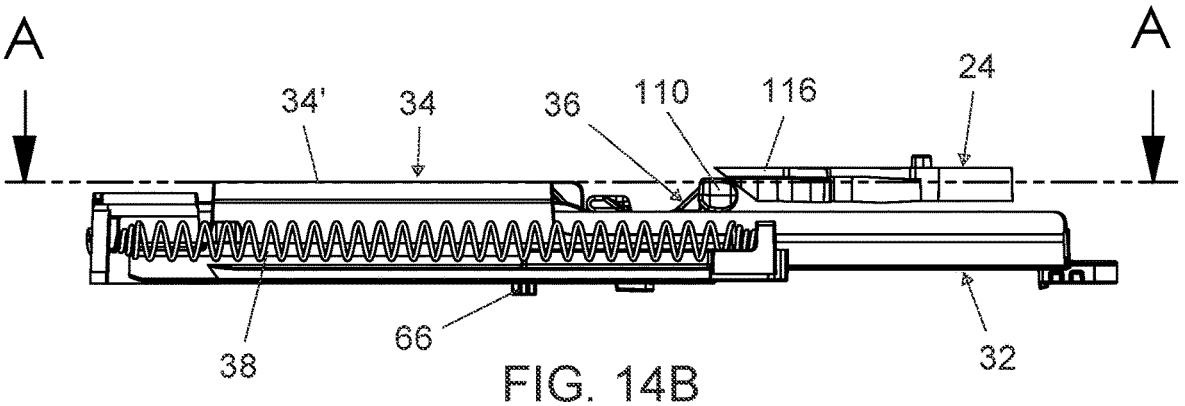
FIG. 14B is a side view of the self-closing mechanism shown in FIG. 14A.
Figure 14C:
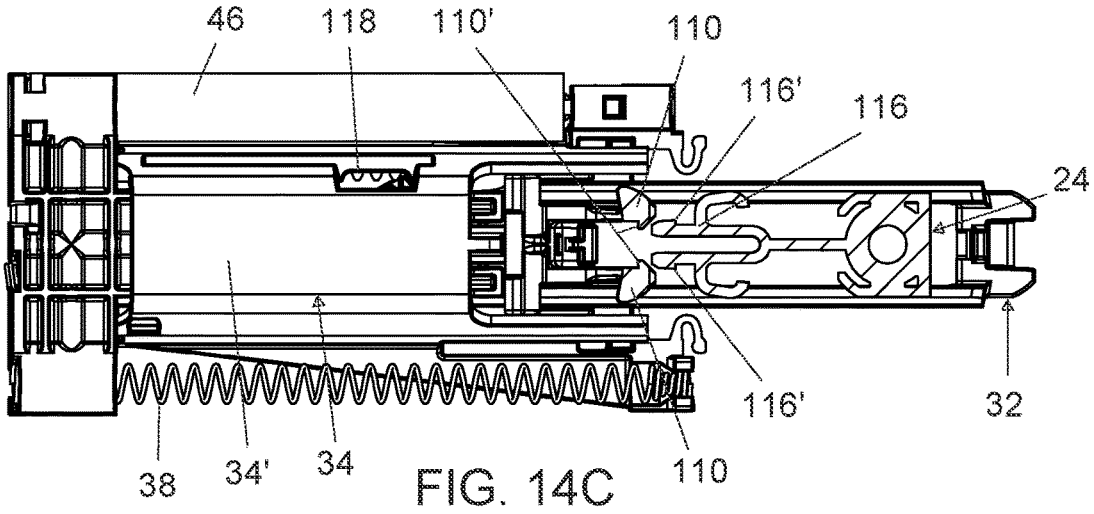
FIG. 14C is a top cross-section view of the self-closing mechanism taken at the section line AA shown in FIG. 14B.
Figure 15A:
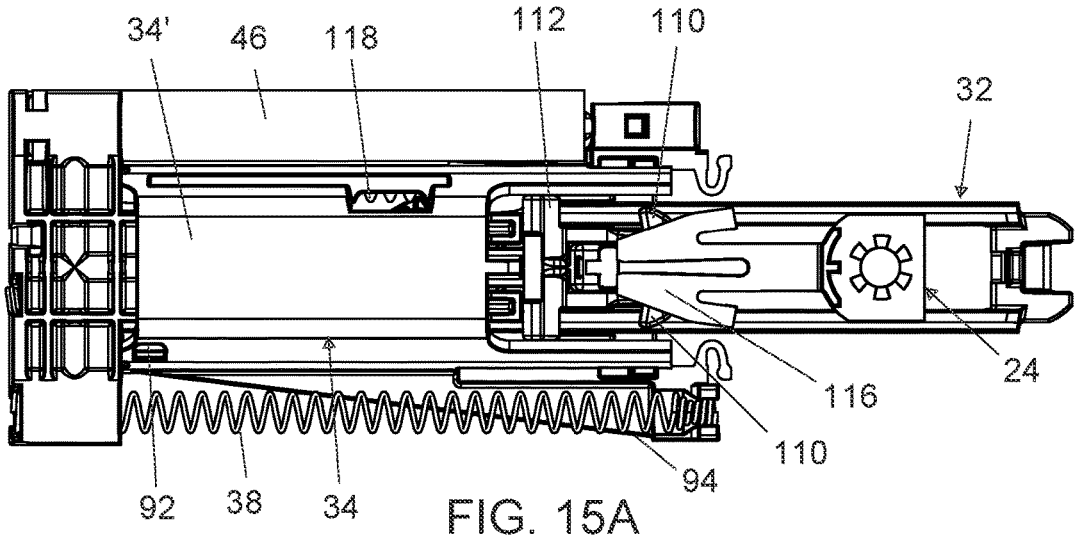
FIG. 15A is a top view of the self-closing mechanism shown in FIG. 14A, but just after the latch has reached the bypass reset position relative to the catch, which will enable the latch to pull the catch to the locked position when the drawer slide is extended.
Figure 15B:
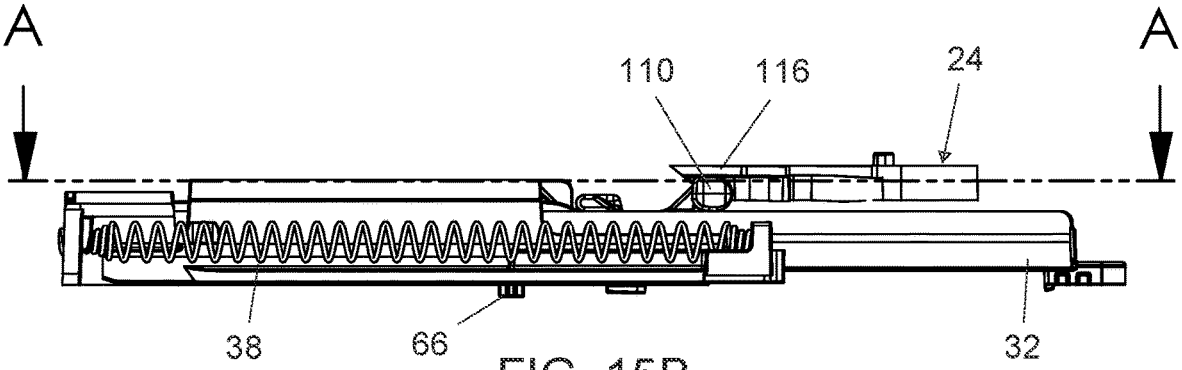
FIG. 15B is a side view of the self-closing mechanism shown in FIG. 15A.
Figure 15C:
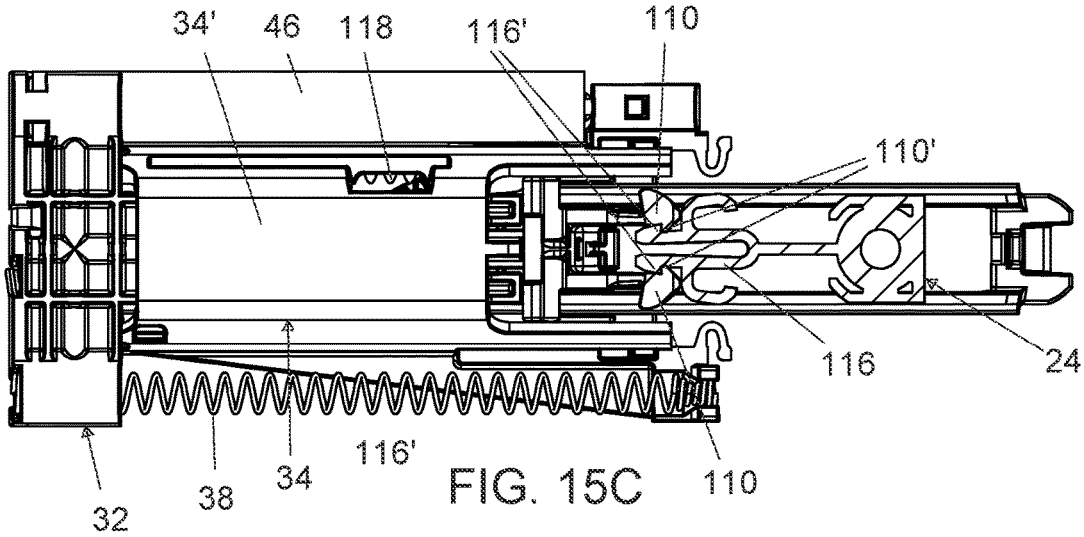
FIG. 15C is a top cross-section view of the self-closing mechanism taken at the section line AA shown in FIG. 15B.

As will be appreciated when viewing FIG. 9A, when a user pulls the drawer (to which the drawer slides 12 are connected) forward toward an open position, the latch 24 coupled to the first slide member 14 is moved forward and the rear of the head 116 of the latch 24 engages the front portions 110 on the catch 36 and tends to pull the catch 36 forward, under the linearly increasing biasing force of the first biasing member 38 and under the non-linearly increasing biasing force of the second biasing member 44. This continues until the rack 118 advances sufficiently to disengage from the gear 40, as seen in FIGS. 10B and 11D, at which point the second biasing member 44 no longer exerts a biasing force against the rack body 34. As the catch 36 and rack body 34 continue moving forward toward the front of the channel 80 in the base 32, they continue to be subjected to the biasing force of the first biasing member 38. At the front of the channel 80, the catch 36 pivots forward and downward until the front portions 110 reach the locked position engaging the front ends 114 of the side walls 82 of the base 32 (the locked position of the catch is shown in FIGS. 4, 9C and 10C). At this juncture, the front portions 110 of the latch 24 duck underneath the catch 36, and the latch 24 releases from the catch 36. The latch 24 and first slide member 14 then are free to continue to move forward with the first drawer slide member 14 and drawer to an open position, no longer under the influence of the self-closing mechanism 22, as may be appreciated in FIG. 9C.

When reversing the drawer and drawer slide movement, such as when a user is pushing a drawer toward the closed position within a cabinet body, the latch 24 on the first slide member 14 moves toward the catch 36 until the forward end of the head 116 of the latch 24 contacts or engages the rear portions 112 of the catch 36 and forces the catch 36 to pivot rearward toward engagement with the top surface of the side walls 82 of the base 32 and the front portions 110 move upward and over the front ends 114 of the side walls 82 of the base 32, so as to release from the locked position, as may be seen in FIG. 9B. The catch 36 and rack body 34 to which it is coupled via the cradle 104 then may by pulled rearward by the first biasing member 38 until the rack 118 of the rack body 34 engaged the gear 40 on the base 32, at which time the second biasing member 44 also exerts a biasing force to move the rack body 34 toward the rear of the base 32, which corresponds with the first slide member 14 and the drawer to which it is connected reaching the rearmost, closed position.

Typical self-closing drawer slides employ a biasing element in the form of a spring, and have a force versus distance traveled graph as shown with respect to the Linear Spring Force plot in FIG. 16, for a single self-closing drawer slide. Given that a drawer would use two such drawer slides, the combined force versus distance traveled graph for a typical prior art drawer configuration is shown with respect to the TYP User Force Linear Spring Systems to Achieve Self-Close. The high level of force required to be able to initially pull the drawer toward the closed position when the self-closing features first reengage during closing of the drawer, must be established at a level that will still provide enough pulling force to achieve and maintain a closed position. Because of the range of forces needed, it will be appreciated with both of the above-identified curves, the spring force increases linearly and to quite a dramatically high level until the self-close feature of the drawer slides reach the locked position and disengage from the drawer at the distance labeled "Open." The sudden drop in force required to continue to pull the drawer open is abrupt and disadvantageous for the reasons previously stated.

The present disclosure further addresses and overcomes this disadvantageous force relationship by providing force modulation via interaction of the gear 40 with the rack 118 along an inner side of one of the guide rails 86 of the rack body 34. Indeed, the advantages are clearly shown in FIG. 16 where one can see the influence of the Gear Force for a single self-closing mechanism 22, as well as the combined influence of the linear spring and gear force in the force modulated FM Slide Open Force, and with respect to a pair of the self-closing mechanisms in User Force PAIR of FM slides. Use of the force modulating gear 40 provides a desirable significantly increased closing force when in and near the closed position, but permits the use of a much lower linear force spring, because of the non-linear application of the spring force from the second biasing member 44. The increased force near the closed position is advantageous with respect to both movement to open and to close a drawer. The disengagement of the gear 40 from the rack 118 also is advantageous, so as to avoid the extreme force otherwise encountered if both biasing members 38, 44 exert increasing force throughout the travel of the rack body 34. This is because a user experiences less force variance throughout the pull, which is preferred. As seen in FIG. 16, when the gear 40 disengages from the rack 118, at approximately 25 mm of travel, the second biasing member 44 no longer exerts force and the closing mechanism 10 is able to stay within a more constant range of applied force. For instance, the example device 10 is able to stay within a range of approximately 3 lbs of force, as opposed to a system using only linear application of force having a range of approximately 6.5 lbs. The increased inward force near the closed position keeps the drawer moving, it is experiencing momentum, reducing the normal slowing that may cause a lack of full closure, which may otherwise occur if less closing force is provided. The use of first and second linear rate biasing members 38, 44, together with the second biasing member 44 being modulated by use of the gear 40 and rack 118, as well as completely disengaged during a portion of the movement of the rack body 34, also advantageously results in a significantly lower closing force at the "Open" position of the closing device 10, thereby reducing the undesirable sudden drop off in force when the self-closing mechanism's release from the outward moving drawer and jerking when first engaging the closing device 10 upon closing of the drawer.

Thus it will be appreciated that in the example embodiment, a closing device 22 includes a base 32, a rack body 34 slidably coupled to the base 32 and having an elongated rack 118, a catch 36 pivotally coupled to the rack body 34, a first biasing member 38 connected at a first end 38' to the base 32 and at an opposed second end 38" to the rack body 34, and biasing the rack body 34 to move rearward relative to the base 32. The catch 36 has a locked position at a front of the base 34, and an unlocked position wherein the catch 36 is movable along the base 32 while being biased toward the rear of the base 32. A gear 40 is pivotally coupled to the base 32 and engaging the elongated rack 118 of the rack body 34, and a second biasing member 44 has a first end 44' coupled to the base 32 and an opposed second end 44" coupled to the gear 40, and biasing the gear 40 to pivot and thereby drive the rack body 34 rearward relative to the base 32. The first biasing member 38 provides a substantially linear biasing force upon movement of the rack body 34 relative to the base 32, and the rack 118 and gear 40 engagement provides a mechanical advantage that alters the biasing force applied to the rack body 34 by the second biasing member 44 in a non-linear manner upon movement of the rack body 34 relative to the base 32.

It will further be appreciated that the example closing device 10 is for use in a drawer slide 12 having a first drawer slide member 14 that is slidably coupled to a second drawer slide member 16, with the closing device 10 including a base 32 connectable to the second drawer slide member 16, a rack body 34 slidably coupled to the base 32 and having an elongated rack 118, a catch 36 is pivotally coupled to the rack body 34, a first biasing member 38 is connected at a first end 38' to the base 32 and at an opposed second end 38" to the rack body 34, and biasing the rack body 34 to move rearward relative to the base 32. The catch 36 has a locked position at a front of the base 32, and an unlocked position wherein the catch 36 is movable along the base 32 while being biased toward the rear of the base 32. A gear 40 is pivotally coupled to the base 32 and engaging the rack 118 of the rack body 34, and a second biasing member 44 has a first end 44' coupled to the base 32 and an opposed second end 44" coupled to the gear 40, and biasing the gear 40 to pivot and thereby drive the rack body 34 rearward relative to the base 32. A latch 24 is connectable to the first drawer slide member 14 and configured to be releasably engaged by the catch 36, wherein the first biasing member 38 provides a substantially linear biasing force upon movement of the rack body 34 relative to the base 32, and the rack 118 and gear 40 engagement provides a mechanical advantage that alters the biasing force applied to the rack body 34 by the second biasing member 44 in a non-linear manner upon movement of the rack body 34 relative to the base 32.

The force modulation by use of the gear 40 is evident in that movement of the rack body 34 relative to the base 32 a given distance causes the second end 44" of the second biasing member 44 to move relative to the first end 44" of the second biasing member 44 a distance that is less than the given distance moved by the rack body 34. It will be appreciated that this is achieved by use of the gear 40, which is sector shape and has an arcuate toothed section, in combination with the rack 118 which has an elongated toothed section that engages the gear 40 arcuate toothed section. The gear 40 is sector-shaped to affect the necessary travel of rack 118. As may be appreciated in FIGS. 10A-10C and 11A-11D, movement of the gear 40 and the coupling of the second end 44" of the second biasing member 44 to the gear 40 are limited such that the second biasing member 44 is prohibited from passing the pivotal coupling 66 of the gear 40 to the base 32. It also will be appreciated that the configuration of the gear 40 may be altered to act over a longer stroke of the closing device 10, but its size will be limited by other components and ultimately by the width of the second slide member 16, if it is going to be installed within the second slide member 16. Nevertheless, it will be appreciated that the configuration of the components in the present disclosure, which uses a combination of linear rate biasing members with one driving a gear, is able to generate an advantageous modulated nearer to constant force profile that achieves desirable closing performance, while also permitting greater closing device travel than in the aforementioned prior art device that uses a gear and a single biasing member, which is connected only to the gear. As will be appreciated, the gear 40 and rack 118 engagement can be positioned so as to turn on or turn off the influence of the second biasing member 44. In the present example, the influence of the second biasing member 44 is most desirable near and at the closed position, while it would be undesirable to have it continue through the full opening movement of the rack body 34.

One additional advantageous feature provides for resetting of the latch 24 relative to the catch 36 in the event that the catch 36 is inadvertently, prematurely released from the front ends 114 of the side walls 82 of the base 32 and moved to the rear of the channel 80 of the base 32. This feature is best illustrated when comparing FIGS. 14A-14C to FIGS. 15A-15C. It will be appreciated that the head 116 of the latch 24 has a flexible, split arrow-shape that permits the two sides of the arrow shape to flex toward each other, thereby permitting outward protrusions 116', seen from the underside of the head 116 in FIGS. 14C and 15C, to bypass or pass between the front portions 110 of the catch 36, and to engage inward protrusions 110' on the front portions 110. This engagement allows the latch 24 to pull the catch 36 forward during the next opening of the drawer, and thereafter to regain the proper relative positioning and movement of the latch 24 and catch 36, as seen in FIGS. 9A-9C. Thus, the bypass feature provides a reset of the normal functioning of the closer device 10.

It will be appreciated that a drawer closing device in accordance with the present disclosure may be provided in various configurations. Any variety of suitable materials of construction, configurations, shapes and sizes for the components and methods of coupling the components may be utilized to meet the particular needs and requirements of an end user. It will be apparent to those skilled in the art that various modifications may be made in the design and construction of such a drawer closing device, whether or not a damper is employed, without departing from the scope or spirit of the present disclosure, and that the claims are not limited to the preferred embodiment illustrated.

While the present disclosure shows and demonstrates example drawer closing devices, the examples are merely illustrative and are not to be considered limiting. It will be apparent to those of ordinary skill in the art that various closing devices may be constructed to be installed in various forms of drawer slides or cabinet assemblies, without departing from the scope or spirit of the present disclosure. Thus, although example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A closing device comprising:

a base;

a rack body slidably coupled to the base and having an elongated rack having a toothed section;

a catch pivotally coupled to the rack body;

a first biasing member connected at a first end to the base and at an opposed second end to the rack body, and biasing the rack body to move rearward relative to the base;

the catch having a locked position at a front of the base, and an unlocked position wherein the catch is movable along the base while being biased toward the rear of the base;

a gear having an arcuate toothed section and being pivotally coupled to the base and engaging the toothed section of the elongated rack of the rack body during a first portion of movement of the rack body relative to the base;

a second biasing member having a first end coupled to the base and an opposed second end coupled to the gear, and biasing the gear to pivot and thereby drive the rack body rearward relative to the base during the first portion of movement of the rack body relative to the base; and wherein during a second portion of movement of the rack body relative to the base the toothed section of the gear is disengaged from the toothed section of the elongated rack so as to remove the biasing via the second biasing member;

wherein the first biasing member provides a substantially linear biasing force upon movement of the rack body relative to the base, and the elongated rack and gear toothed engagement provides a mechanical advantage that alters the biasing force applied to the rack body by the second biasing member in a non-linear manner during the first portion of movement of the rack body relative to the base while no biasing is applied by the second biasing member during the section portion of movement of the rack body relative to the base.

2. The closing device in claim 1 wherein movement of the rack body relative to the base a given distance causes the second end of the second biasing member to move relative to the first end of the second biasing member a distance that is less than the given distance moved by the rack body.

3. The closing device in claim 1 wherein the gear is sector-shaped.

4. The closing device in claim 3 wherein movement of the gear and the coupling of the second end of the second biasing member to the gear are limited such that the second biasing member is prohibited from passing the pivotal coupling of the gear to the base.

5. The closing device in claim 1 wherein each of the first and second biasing members is in the form of a coiled spring.

6. The closing device in claim 1 further comprising a damper that dampens movement of the rack body in at least one direction.

7. The closing device in claim 6 wherein a first end of the damper is coupled to the base and a second end of the damper is coupled to the rack body.

8. The closing device in claim 1 wherein the base further comprises a pair of side walls defining a channel between the side walls.

9. The closing device in claim 8 further comprising a rack tie and wherein the rack body further comprises a pair of guide rails that slide along the side walls of the base, and the rack tie engages a lower surface of the side walls of the base and slidably engages a lower surface of the guide rails of the rack body.

10. The closing device in claim 8 wherein the rack body further comprises a pair of guide rails that slide along the side walls of the base, a top wall that extends between and is connected to the guide rails, the elongated rack extends along at least a portion of one of the guide rails, the rack body has a forward extending cradle and the catch is pivotally coupled to the cradle.

11. The closing device in claim 8 wherein the catch is slideably coupled to the side walls of the base.

12. The closing device in claim 11 wherein each side wall of the base further comprises an undercut slot and the catch further comprises lateral extensions slidably engages the undercut slots of the side walls.

13. The closing device in claim 10 wherein each of the side walls of the base has a front end and the catch further comprises upward extending front portions, wherein the catch has a locked position wherein the catch is at a front end of the channel and the front portions are forward of and engage the front ends of the side walls of the base, and the catch has an unlocked position wherein the front portions are disposed above and movable relative to the side walls of the base.

14. The closing device in claim 13 wherein the catch further comprises upward extending rear portions that are disposed above and slidable relative to the side walls of the base.

15. A closing device, for use in a drawer slide having a first drawer slide member that is slidably coupled to a second drawer slide member, the closing device comprising:

a base connectable to the second drawer slide member;

a rack body slidably coupled to the base and having an elongated rack;

a catch pivotally coupled to the rack body;

a first biasing member connected at a first end to the base and at an opposed second end to the rack body, and biasing the rack body to move rearward relative to the base;

the catch having a locked position at a front of the base, and an unlocked position wherein the catch is movable along the base while being biased toward the rear of the base;

a gear pivotally coupled to the base in a location along the first biasing member and engaging the elongated rack of the rack body only during a portion of the movement of the rack body relative to the base;

a second biasing member having a first end coupled to the base and an opposed second end coupled to the gear, and biasing the gear to pivot and thereby drive the rack body rearward relative to the base during the portion of movement of the rack body while the gear engages the elongated rack;

a latch connectable to the first drawer slide member and configured to be releasably engaged by the catch;

wherein the first biasing member provides a substantially linear biasing force upon movement of the rack body relative to the base, and the elongated rack and gear engagement provides a mechanical advantage that alters the biasing force applied to the rack body by the second biasing member in a non-linear manner upon movement of the rack body relative to the base while the gear is engaged with the elongated rack.

16. The closing device in claim 15 wherein the gear further comprises teeth and the elongated rack further comprises teeth that engage the teeth of the gear during the portion of the movement of the rack body relative to the base wherein the gear engages the elongated rack.

17. The closing device in claim 15 further comprising a damper that is coupled to and dampens movement of the rack body relative to the base in at least one direction.

18. The closing device in claim 17 wherein the damper further comprises a cylinder coupled to the base and a rod coupled to the rack body.

19. The closing device in claim 15 wherein the latch is configured to be releasably engaged by the catch while the first drawer slide member is biased to move over the rack body and the base to a closed position.

20. The closing device in claim 15 wherein the latch further comprises a flexible head having protrusions that enable the latch to bypass the catch if the catch moved to a closed position relative to the base prior to being engaged by the latch.

21. The closing device in claim 15 wherein the base further comprises a pair of side walls defining a channel between the side walls.

22. The closing device in claim 21 further comprising a rack tie and wherein the rack body further comprises a pair of guide rails that slide along the side walls of the base, and the rack tie engages a lower surface of the side walls of the base and slidably engages a lower surface of the guide rails of the rack body.

23. The closing device in claim 15 wherein the base is configured to be positioned within a drawer slide member, along a web and between outer bearing rails of the drawer slide member.

* * * * *